US006000758A

United States Patent [19]

Schaffner et al.

[11] Patent Number: 6,000,758

[45] Date of Patent: Dec. 14, 1999

[54] RECLINING LIFT CHAIR

[75] Inventors: Walter E. Schaffner, Shavertown; Carl A. Kollar, Nanticoke; James P. Mulhern, Hunlock Creek; Ronald J. Levi, W. Wyoming; Stephen J. Antonishak, Alden, all of Pa.

[73] Assignee: Pride Health Care, Inc., Exeter, Pa.

[21] Appl. No.: 08/686,421

[22] Filed: Jul. 26, 1996

[51] Int. Cl.[6] ..... A47C 1/02

[52] U.S. Cl. ..... 297/344.17; 297/DIG. 10; 297/180.12; 297/83; 297/84; 601/49

[58] Field of Search ..... 297/344.17, DIG. 10, 297/83, 84, 85, 180.1, 180.12; 601/49

[56] References Cited

U.S. PATENT DOCUMENTS

| | | | |
|---|---|---|---|
| 2,587,731 | 3/1952 | Irving | 297/180.12 X |
| 2,684,672 | 7/1954 | Summerville | 297/180.1 X |
| 3,136,577 | 6/1964 | Richard | 297/180.12 X |
| 3,138,402 | 6/1964 | Heyl, Jr. et al. | 297/344.17 X |
| 3,246,118 | 4/1966 | Sayles et al. | 297/180.12 |
| 3,479,086 | 11/1969 | Sheridan | 297/DIG. 10 X |
| 3,732,860 | 5/1973 | Thurmer | 601/49 |
| 3,948,379 | 4/1976 | Warner | 297/180.12 X |
| 4,007,960 | 2/1977 | Gaffney | 297/DIG. 10 X |
| 4,083,599 | 4/1978 | Gaffney | 297/DIG. 10 X |
| 4,258,706 | 3/1981 | Shank | 297/180.12 X |
| 4,386,803 | 6/1983 | Gilderbloom | 297/84 |
| 4,453,766 | 6/1984 | DiVito | 297/DIG. 10 X |
| 4,786,107 | 11/1988 | Crockett | 297/DIG. 10 X |
| 4,838,612 | 6/1989 | Cross | 297/DIG. 10 X |
| 4,852,939 | 8/1989 | Kruaska | 297/DIG. 10 X |
| 4,902,071 | 2/1990 | McGee et al. . | |
| 4,909,569 | 3/1990 | Gaffney | 297/DIG. 10 X |
| 4,946,222 | 8/1990 | Matson | 297/DIG. 10 X |
| 4,969,684 | 11/1990 | Zarotti | 297/180.12 |
| 4,993,777 | 2/1991 | LaPointe | 297/DIG. 10 X |
| 5,061,010 | 10/1991 | LaPointe | 297/DIG. 10 X |
| 5,076,644 | 12/1991 | Northcutt | 297/DIG. 10 X |
| 5,095,561 | 3/1992 | Green et al. | 297/DIG. 10 X |
| 5,165,753 | 11/1992 | Henderson | 297/DIG. 10 X |
| 5,203,610 | 4/1993 | Miller | 297/DIG. 10 |
| 5,215,351 | 6/1993 | Lapointe | 297/DIG. 10 X |
| 5,216,769 | 6/1993 | Eakin | 601/49 X |
| 5,219,204 | 6/1993 | Bathrick et al. | 297/DIG. 10 X |
| 5,265,935 | 11/1993 | Geisler et al. | 297/DIG. 10 X |
| 5,286,046 | 2/1994 | Bottemiller et al. . | |
| 5,294,179 | 3/1994 | Rudes et al. | 297/DIG. 10 X |
| 5,312,153 | 5/1994 | Lin | 297/DIG. 10 X |
| 5,314,238 | 5/1994 | Komorowski et al. | 297/DIG. 10 X |
| 5,320,122 | 6/1994 | Jacobson, II et al. | 297/DIG. 10 X |
| 5,421,692 | 6/1995 | Varrichio et al. . | |
| 5,437,607 | 8/1995 | Taylor | 601/49 |
| 5,437,608 | 8/1995 | Cutler | 601/49 |
| 5,466,046 | 11/1995 | Komorowshi et al. | 297/85 X |
| 5,467,002 | 11/1995 | Brooks et al. | 297/330.1 |
| 5,482,350 | 1/1996 | Komorowski et al. | 297/85 |
| 5,520,439 | 5/1996 | Blount | 297/DIG. 10 X |

*Primary Examiner*—Jose V. Chen
*Assistant Examiner*—Rodney B. White
*Attorney, Agent, or Firm*—Charles N. Quinn, Esq.

[57] ABSTRACT

The lift chair has a base frame, an extendable/retractable chair occupant positioning apparatus attached to the base frame, a reversible D.C. motor for extension and retraction of the chair occupant positioning apparatus relative to the base frame. A control means is connected to the D.C. motor for actuation of the chair occupant positioning device. A power supply is connected to the control means for motor control. A chair occupant carriage is supported by the base frame. The carriage has a seat and a back portion.

66 Claims, 29 Drawing Sheets

RECLINING LIFT CHAIR

BACKGROUND OF THE INVENTION

1. Field of the Invention

This invention relates to lift chairs for use by elderly, disabled and infirm persons. The lift chair reclines from a normal, upright, seated position to a position in which the chair back has reclined and a leg support platform has moved from vertical to horizontal to provide support for the reclining occupant's leg. The lift chair can be returned from the reclining position to an upright position whereupon the lift chair can be actuated through a continuous range of motion to lift and pitch forward thereby assisting the chair occupant in arising from the chair.

2. Description of the Prior Art

U.S. Pat. No. 3,138,402 discloses an invalid chair having a pivotally mounted seat or cushion portion, divided into front and rear cushioned sections. A four bar linkage is utilized to lift the rear cushioned section separating the same from the front cushioned section and is actuated by a bell crank shaped link 63. Two links 19, 22 and plate portions between pivots 21 and 23 at the front and pivots 36 and 37 at the rear form a parallelogram or four-bar linkage support. This support produces rotation of a front cushioned section 31 and upward and forward movement of chair frame 24 from the position illustrated in FIG. 1 of '402 to the position illustrated in FIG. 2 of '402 (Column 3, lines 41–48 and FIGS. 1 and 2 of U.S. Pat. No. 3,138,402). A motor drives a lead screw in a direction to move a nut 41 to the rear in '402. This moves operating links 58 and bell crank link 63 to the rear, causing projecting end 66 thereof to engage a cross-brace 29. This, in turn, moves links 19 and 20 counterclockwise, rotates the front cushioned section 31 about a pivot 21 and raises chair frame 24 upwardly and forwardly to the position illustrated in FIG. 2 of '402. This raises and slides the occupant forwardly from the rear cushioned section into a standing position (Column 4, lines 20–27 of '402).

'402 also discloses an ottoman or leg support structure as an option in FIG. 4 thereof. By moving a switch actuating element 69 of a switch 67 to position for raising chair frame 24, the motor of '402 is reversed to drive a nut to the rear, permitting springs 91 to return the ottoman of '402 to its nested position, as illustrated in FIGS. 1 and 2 of '402. The switch is released at this point unless the occupant desires to be raised to standing position in which case holding the switch in the position for retracting the ottoman continues to drive nut 41 to the rear on lead screw 39, thereby moving the chair frame to a raised position as illustrated in FIG. 2 of '402 (Column 5, lines 3–13 of '402).

U.S. Pat. No. 4,007,960 discloses a reclining elevator chair which, in a first mode of operation, has drive means which drives a reclining mechanism to tilt the back of the chair and extend and retract the leg rest. In the second mode of operation, the drive means drives the elevator mechanism to raise the seat of the chair and tilt it slightly forward. Near the upper end of the elevation range of the chair seat, the mechanism is effectuated to tilt the seat back rearwardly to avoid imposition of objectionable pressure on the occupant of the chair (Column 1, lines 20–28 of '960). Transfer between the first and second modes of operation is effectuated by a ram acting through a part of its range of extension to swing a crank about its pivot to drive a recliner mechanism in the first mode. When the ram acts through a different part of its range, it abuts the crank against the seat frame to inactivate the recliner mechanism and drives the elevator mechanism in the second mode (Column 1, lines 31–37 of '960).

In the first mode of operation, the power actuated drive means drives the recliner actuator means or mechanism to tilt the chair back 12 to a recline position illustrated in FIG. 3 of '960 and to simultaneously extend and tilt a leg rest 16. In a second mode of operation, the same drive means drives elevator means or mechanism to raise seat 14 and tilt it forwardly as illustrated in FIGS. 4 and 11. Sides 10, back 12 and leg rest 16 rise along with seat 14 in the second mode of operation (Column 2, lines 27–30 and 32–37 of '960).

The elevator means or mechanism includes two sets of paired laterally spaced arms 26 and 28 pivotally connected at the rear ends by pintles 30, 32 to corresponding plates 24 at opposite sides of the chair. The forward ends of swing arms 26 and 28 are pivotally connected to corresponding laterally spaced seat support plates 34 illustrated in FIGS. 7 and 9 of '960 (Column 2, lines 54–60 of '960).

U.S. Pat. No. 4,852,939 discloses a device for converting a recliner chair to a recliner-lift chair.

Use of paired laterally spaced arms 26 and 28 as disclosed in '960 has been implemented in a manner to drive a lift chair seat portion using a bracket and pivot arrangement as illustrated in FIG. 26 where a prior art linkage mechanism is illustrated isometrically and partially broken and is designated generally 500. A drive extension shaft from a motor is designated 502 and is connected via a collar 504 and a pin 506 to a pair of plates 508 defining a bracket designated generally 510 which is fixedly connected to a cross-bar 512 of a T-member designated generally 514. A leg portion 516 of T-member 514 is pivotally retained in a bracket 518 defined by two parallel plates 520 with the point of pivotal connection between leg 516 and bracket 518 being defined by pivot rod 522. Bracket 518 is secured to a cross-member 524 of a lift chair frame by welding; cross-member 524 is elevated together with the lift chair upon drive extension shaft 502.

Pivotally connected to cross-bar 512 are a pair of chair seat portion support arms 526 which are pivotally connected to extension tabs 528 formed at the ends of and integrally with cross-bar 512. with pivotal connection between extension tabs 528 and seat portion support arms 526 effectuated via pins 530.

SUMMARY OF THE INVENTION

In one of its aspects, this invention provides a lift chair which has a seat portion, a back portion and a leg support portion. A DC motor serves to drive the lift chair, moving the lift chair between a conventional position at which the occupant sits upright in the lift chair with the occupant's feet on the floor, a position at which the occupant's feet and legs are supported in a horizontal position while the occupant's torso remains in a conventional sitting position, a position at which the occupant's feet and legs remain in a horizontal position and the occupant's torso and head recline due to tilting of the seat portion of the chair and reclining of the back portion of the chair, and a position at which the seat and leg support portion is folded into a conventional vertical disposition and the chair is lifted and tilted forward thereby to assist the occupant in exiting the chair.

Use of a DC motor together with a worm gear-rack combination where the worm gear-rack are preferably dissimilar materials with one of the worm gear and rack being plastic, preferably nylon and the remaining one of the worm gear and rack being metal, preferably steel or aluminum, together with a low voltage DC motor and novel features in the linkages facilitating movement of the chair responsively to the motor drive, result in substantially smooth transitory motion of the chair throughout the motion range with exceedingly high comfort provided for the chair occupant.

In one of its aspects, the lift chair of the invention includes not only a seat portion, a back portion, a leg support portion and a DC motor as recited above but also longitudinally spaced transversely extending front and rear frame base rails together with a pair of transversely spaced longitudinally extending side frame base rails which are rigidly connected to the front and rear frame base rails remotely from the ends thereof, preferably by welding, to provide an extremely high strength framework for supporting the lift chair on a floor.

The lift chair according to the invention may further include pairs of upstanding transversely spaced rear frame side plates fixedly connected to respective ones of said side frame base rails at positions of connection thereof with the rear frame base rail.

The lift chair lift mechanism in one of the aspects of the invention further includes two pairs of elevator arms with respective pairs of elevator arms being vertically aligned with respective ones of the side frame base rails and pivotally mounted in and retained between respective rear frame side plates of said plate pairs for co-planar arcuate vertical movement with respect thereto.

One aspect of the invention further encompasses the structure whereby ends of the elevator arms remote from the rear frame side plates are pivotally mounted in and retained between pairs of front frame side plates in a manner that rotation of the elevator arms about the positions of pivotal mounting in the rear frame side plates results in arcuate upward movement of the remote ends of the elevator arms and the front frame side plates having the ends sandwiched therebetween. Desirably, the front and rear frame side plates are identical, being drilled such that the plates may be used in either position, interchangeably one with another.

The lift chair of the invention desirably further includes a pair of elevator frame side members retained between respective front frame side plates of the pairs and extending generally longitudinally therefrom.

A front elevator frame cross-member is attached to the front frame side plates with the front elevator frame cross-member extending generally transversely respecting the chair. The front elevator frame cross-member desirably has a transverse central portion extending between the positions of attachment to the front frame side plates, vertical portions extending generally downwardly from the central portion and transverse extremity portions extending outwardly in the transverse direction from lower portions of the vertically extending portions.

The chair further desirably includes a rear elevator frame cross-member fixedly connected to the elevator frame side members proximate the rear extremities thereof. The rear elevator cross-member desirably has a transversely extending central portion, generally vertically oriented intermediate portions leading generally downwardly from the central portion and being connected thereto via general curvatures and transverse extremity portions extending transversely outwardly from the respective lower vertical extremities of the vertical portions. The rear elevator frame member is desirably connected to the elevator frame side members via contact therewith along vertical portions of the rear elevator frame cross-member below the positions of curvature. This provides a margin of safety in the event of a failure of one of the welds securing the rear elevator frame cross-member to the elevator frame side members.

The lift chair according to the invention further desirably includes a bell crank pivotally connected to the front elevator frame cross-member proximate the mid-point of the transverse central portion thereof. The bell crank is desirably rotatable about a transverse axis from a position contacting a rearwardly facing surface of the front elevator frame cross-member to a position at which the bell crank has rotated away from and out of contact with the front elevator frame cross-member.

The lift chair further embraces a T-bracket pivotally connected to the bell crank at an extremity position remote from position of bell crank pivotal attachment to the front elevator frame cross-member. The T-bracket desirably has a leg portion pivotally connected to the bell crank for pivotal motion respecting the bell crank about a transverse axis, a transversely extending cross-member and a pair of longitudinal seat portion support linkage bars fixedly connected to the cross-member at respective transverse extremities thereof, where the longitudinal seat support linkage bars are desirably parallel one with another.

The chair further embraces a pair of chair seat portion support brackets pivotally connected to respective ones of the longitudinal seat portion support linkage bars at extremities thereof remote from connection with the cross-member of the T-bracket, with the chair seat portion support brackets being fixedly secured via screw means to the seat portion of the lift chair.

In another of its aspects, the invention includes a motor driven lift chair movable along a continuous range from a reclined position which a back portion of the chair is preferably reclined relative to a seat portion of the chair and a leg support portion extends from the seat portion for horizontally supporting lower extremities of the chair occupant through a position at which the back portion is upright relative to the seat portion and the leg support portion continues to be in the occupant lower extremities horizontal support position, to a further position at which the leg support portion extends downwardly from the seat portion thereby to permit the chair occupant's lower extremities to extend to the floor, to a position at which the leg support portion remains so-positioned and the back and seat portions remain at a sitting position respecting one another and the chair is lifted to be able to assist the occupant in arising from the chair, where the chair preferably further includes a motor having an extended output shaft portion for extending and retracting preferably according to direction of the motor rotation.

The chair further preferably includes a bell crank pivotally connected to the motor output shaft for rotation responsively to extension/retraction of the motor output shaft.

The chair preferably includes a base. The motor desirably pivotally connects with the base to facilitate arcuate motion of the motor upon extension/retraction of the motor shaft.

A bell crank is pivotally connected to a chair seat support member at a pivotal connection removed from the pivotal connection of the bell crank and the motor output shaft.

The bell crank is preferably further pivotally connected to a first bar of a four-bar linkage; the base of the chair preferably defines the second bar of the four-bar linkage. Third and fourth bars of the four-bar linkage are preferably elevator bars preferably connecting the base with the first bar and raising the first bar relative to the base upon extension of the motor output shaft rotating the bell crank into abutting disposition with the seat support member and thereafter preferably causing the third and fourth elevator bars to elevate the first bar in response to continued extension of the motor output shaft. Desirably, the axes of pivotal connection to the bell crank are all parallel. Further desirably, the axis of pivotal connection of the motor output shaft and the bell crank is preferably vertically above the axis of pivotal connection of the bell crank and the first bar when the bell crank initially contacts the first bar due to extension of the motor output shaft.

The bell crank is most preferably triangular and further preferably is a three-four-five right triangle with the pivotal connection of the motor output shaft and the bell crank being opposite the hypotenuse of the right triangle. Further desirably, the four-side of the triangle connects the pivotal connection of the motor output shaft with the bell crank and the point of pivotal connection between the bell crank and the first bar.

In another of its aspects, the lift chair embraces means for rearwardly tilting the seat portion and reclining the back portion responsively to rotation of the bell crank away from the front elevator frame cross-member where the tilting and reclining means include a first generally longitudinally extending bar. A second bar is pivotally connected to the first bar in a position more proximate a front end of the first bar than a rear end thereof. A third longitudinal bar is fixed connected to the seat portion of the chair. A fourth generally longitudinal bar is pivotally connected to the first bar more proximate the rear end of the first bar than to the forward end thereof. A fifth pivotally movable bar is of generally triangular shape and is pivotally connected to the third longitudinal bar proximate the forward end thereof, with the connection being proximate one vertex of the triangularly shaped fifth pivotally movable bar. The fifth pivotally movable bar is also pivotally connected to the fourth longitudinal bar proximate the forward end thereof and a second vertex of the triangularly shaped fifth pivotally movable bar. This portion of the invention further embraces a sixth pivotally movable bar which is pivotally connected to the third longitudinal bar proximate the rear end thereof and is pivotally movable respecting the third longitudinal bar in the seat portion. The sixth pivotally movable bar is pivotally connected to an end of the second pivotally movable bar remote from the point of pivotal connection with the first bar. The second bar and fourth bars are desirably pivotally connected one to another proximate their respective mid-points.

In yet another aspect of the invention, there is provided a scissors-type linkage for moving the leg support portion of the chair from a vertical position to a horizontal leg supporting position responsively to rotational motion of the bell crank without substantial reclining movement of the chair. In this aspect of the invention, the scissors-type linkage includes a first link pivotally connected to the third longitudinal bar proximate the forward end thereof. A second link is pivotally connected to the fifth triangularly shaped pivotally movable bar and a third vertex of such fifth bar. An end of the first link remote from the point of pivotal connection with the third longitudinal bar is pivotally connected to the second link proximate the mid-point of the second link. A third link is pivotally connected to the first link at the point of connection thereof with the second link. A fourth link is pivotally connected to the second link at an extremity thereof remote from a point of connection of the second link with the fifth pivotally movable bar. A fifth link is pivotally connected to the third link at the extremity thereof remote from the point of connection of the third link with the first link. The fourth link and the fifth link are pivotally connected proximate respective mid-points thereof. A sixth link is pivotally connected to the fourth link at an extremity thereof remote from connection of the fourth link and the second link. Extremities of the fifth link and the sixth link remote from the points of connection with the fourth link are pivotally connected to the leg support portion of the chair at separated pivotal connection points.

An important aspect of the invention resides is the provision of one-piece construction of the front elevator frame cross-member and one-piece construction of the rear elevator frame cross-member. These members include curvatures connecting the transversely extending generally horizontal portions and vertical portions of the members providing very substantial strength. When these members are formed in such curved shapes, the curving of these members, which are desirably fabricated from rectangular cross-section hollow tubular stock, results in formation of a web or flange in the upwardly and downwardly facing surfaces of the tubular front elevator frame cross-member and the rear elevator frame cross-member at the positions of curvature thereof. Such one-piece construction provides additionally a location for attachment of the chair by bolting such that in the event of a failure of a weldment connecting the rear elevator frame cross-member to the elevator frame side member, the curved configuration of the rear elevator frame cross-member prevents the chair and its occupant from dropping more than an inch or two. Specifically, should the weld fail while the chair is being elevated or at the position of maximum elevation, the chair will not fall any significant distance; the occupant will experience a drop of only one or two inches of the chair seat as a result of the central transverse portion of the rear elevator frame cross-member contacting the elevator frame side member(s) thereby stopping downward travel. The rear elevator frame cross-member bears a major portion of the load during lift chair operation, particularly during lift chair elevation due to the geometry and the fact that the major portion of the occupant's weight is above the rear elevator frame cross-member.

One-piece construction of the front elevator frame cross-member and the rear elevator cross-member also provides greater resistance to twisting thereby reducing side loadings on pins and bushings which provide pivotal connections of the various bars and linkages, contributing to longer bushing life and longer, more reliable and quieter operation of the lift chair embodying these aspects of the invention.

In another aspect of the invention, the frame side plates, which may be used interchangeably as front or rear frame side plates, are fabricated with an offset included therein. These offsets provide openings into which the relevant elevator arms may move during chair operation thereby providing some"lead" for the arms when they move in the pivoting fashion. Provision of this "lead", by virtue of the plates including the offset portions, provides more trouble-free and quieter chair operation over the long term as various components of the chair are otherwise stressed during chair usage.

The degree of motion of the lift chair manifesting aspects of the invention is adjustable by virtue of rue and clevis pins which retain elevator arm portions of the lift chair mechanism in place. This permits adjustment of the pitch or tilt of the chair as the lifting occurs and is easily effectuated in the home setting by a trained service personnel.

BRIEF DESCRIPTION OF THE DRAWINGS

FIG. 6 corresponds to FIG. 1 respecting the position of the linkage depicted schematically in FIG. 1.

FIG. 7 corresponds to FIG. 2 respecting the position of the linkage depicted schematically in FIG. 2.

FIG. 8 corresponds to FIG. 3 respecting the position of the linkage depicted schematically in FIG. 3.

FIG. 9 corresponds to FIG. 4 respecting the position of the linkage depicted schematically in FIG. 4.

FIG. 10 corresponds to FIG. 5 respecting the position of the linkage depicted schematically in FIG. 5.

DETAILED DESCRIPTION OF THE PREFERRED EMBODIMENT

AND BEST MODE KNOWN FOR PRACTICING THE INVENTION IN ACCORDANCE WITH 35 USC 112

Figure 6:
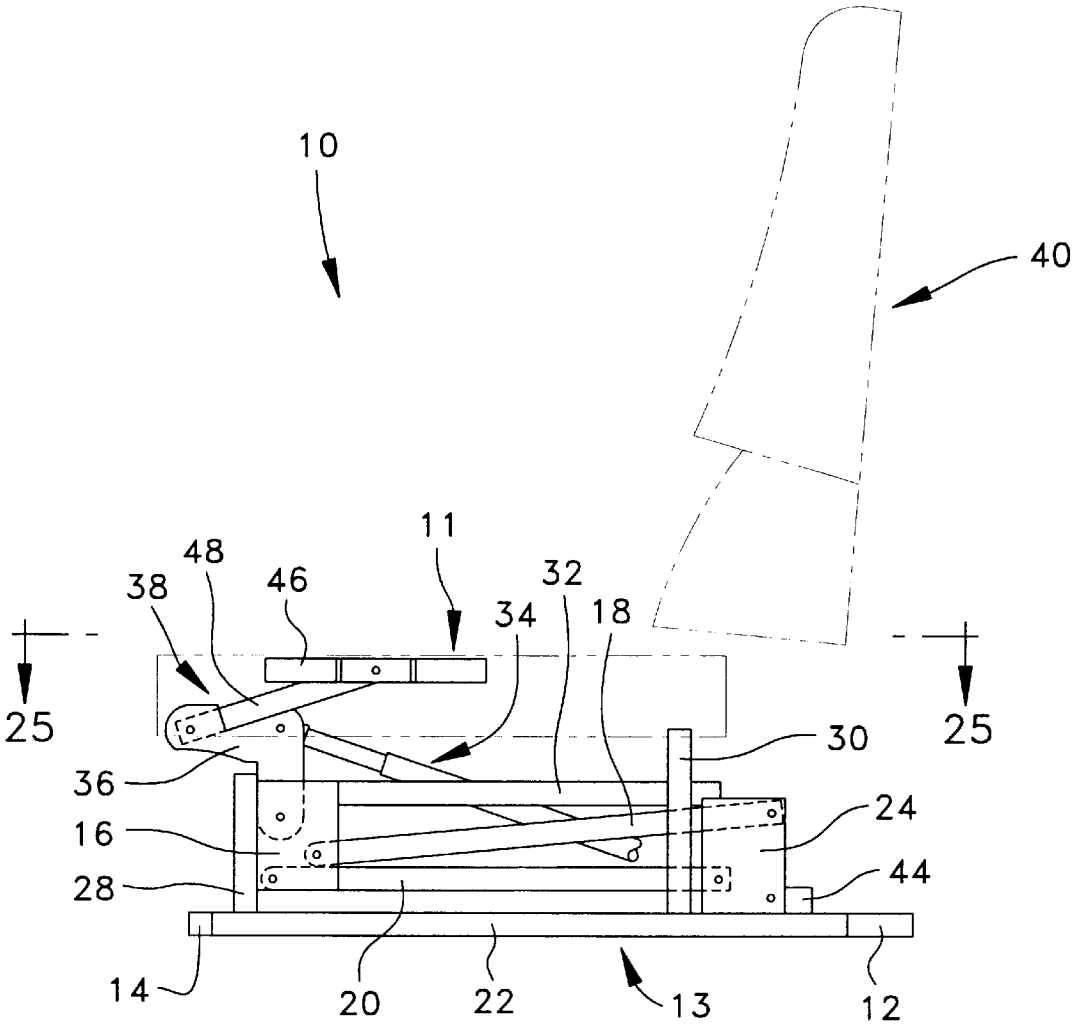
FIG. 6 is an interior side view, taken at arrows 6—6 in FIG. 13, of a portion of the lift mechanism of the lift chair of the invention in which certain side and other portions of the chair have been removed to reveal the illustrated portion of the lift mechanism and the chair seat and chair back have been illustrated in phantom, with the lift chair depicted in the neutral or conventional seating position.
Figure 7:
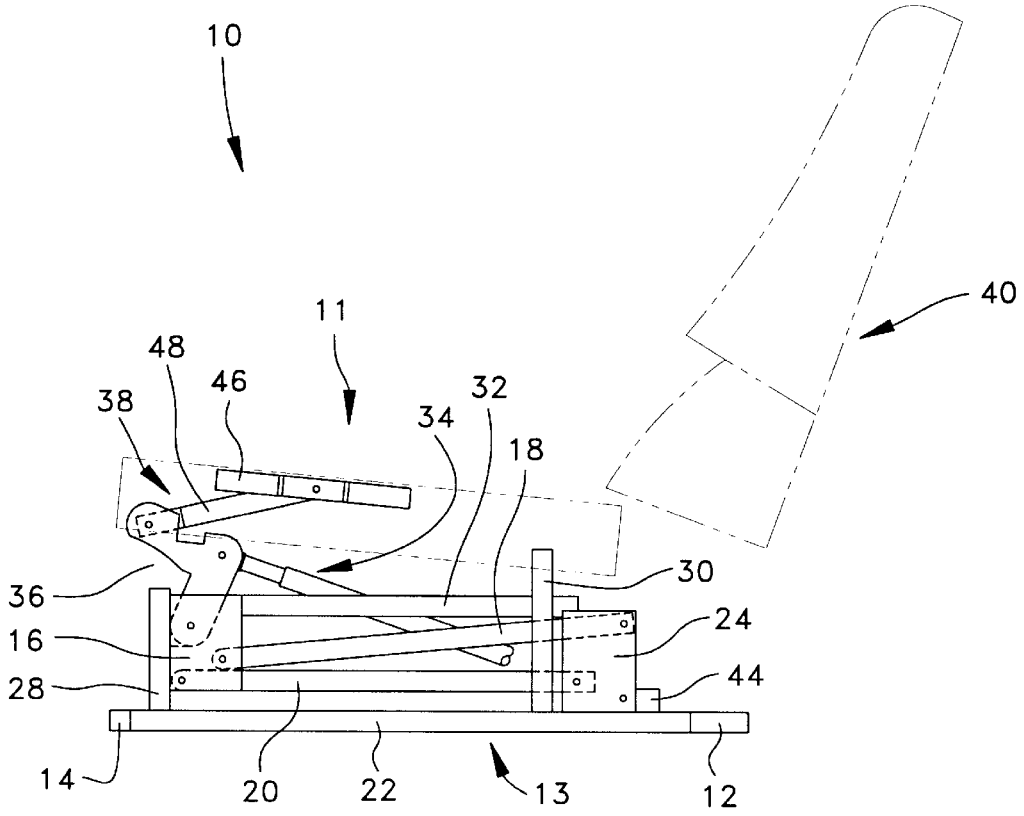
FIG.7 interior side view similar to and taken at the same position as FIG. 6 but with the lift chair somewhat reclined.
Figure 8:
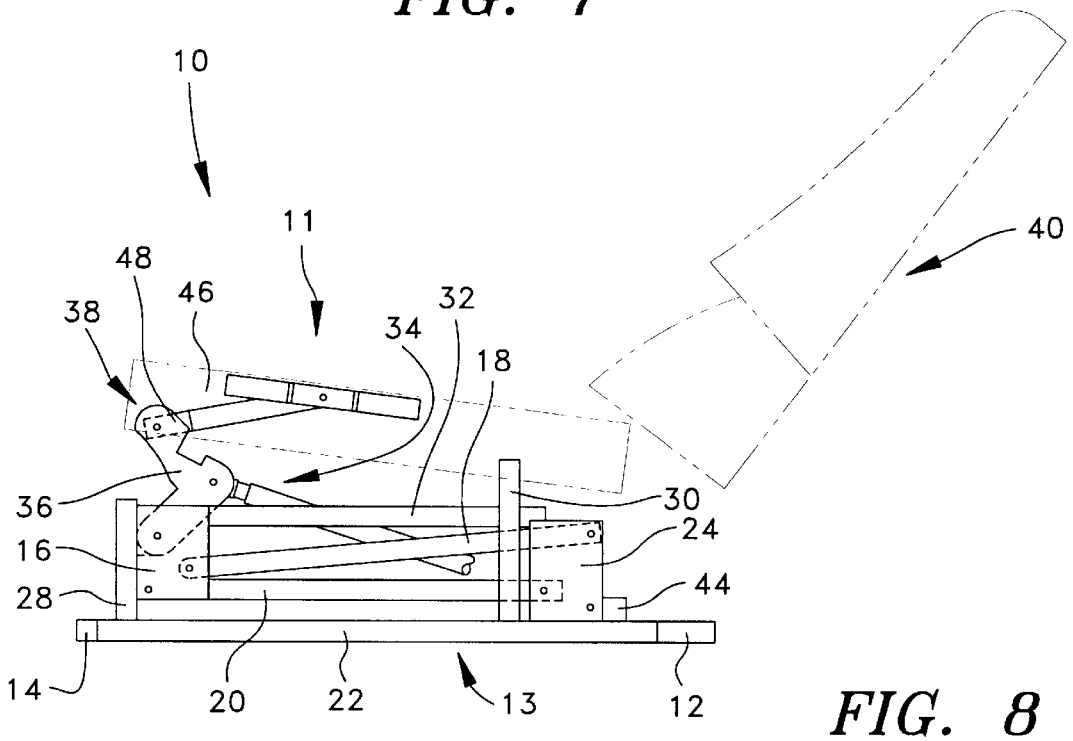
FIG. 8 is an interior side view similar to and taken at the same position as FIGS. 6 and 7 but with the lift chair fully reclined.

Referring to the drawings in general and to FIG. 6 in particular, a lift chair manifesting aspects of the invention according to the preferred embodiment of the invention is shown schematically and designated generally 10. A lift mechanism for lift chair 10 is designated generally 11 in FIG. 6. Not all of lift mechanism 11 is illustrated in FIG. 6, for purposes of drawing clarity.

Figure 12:
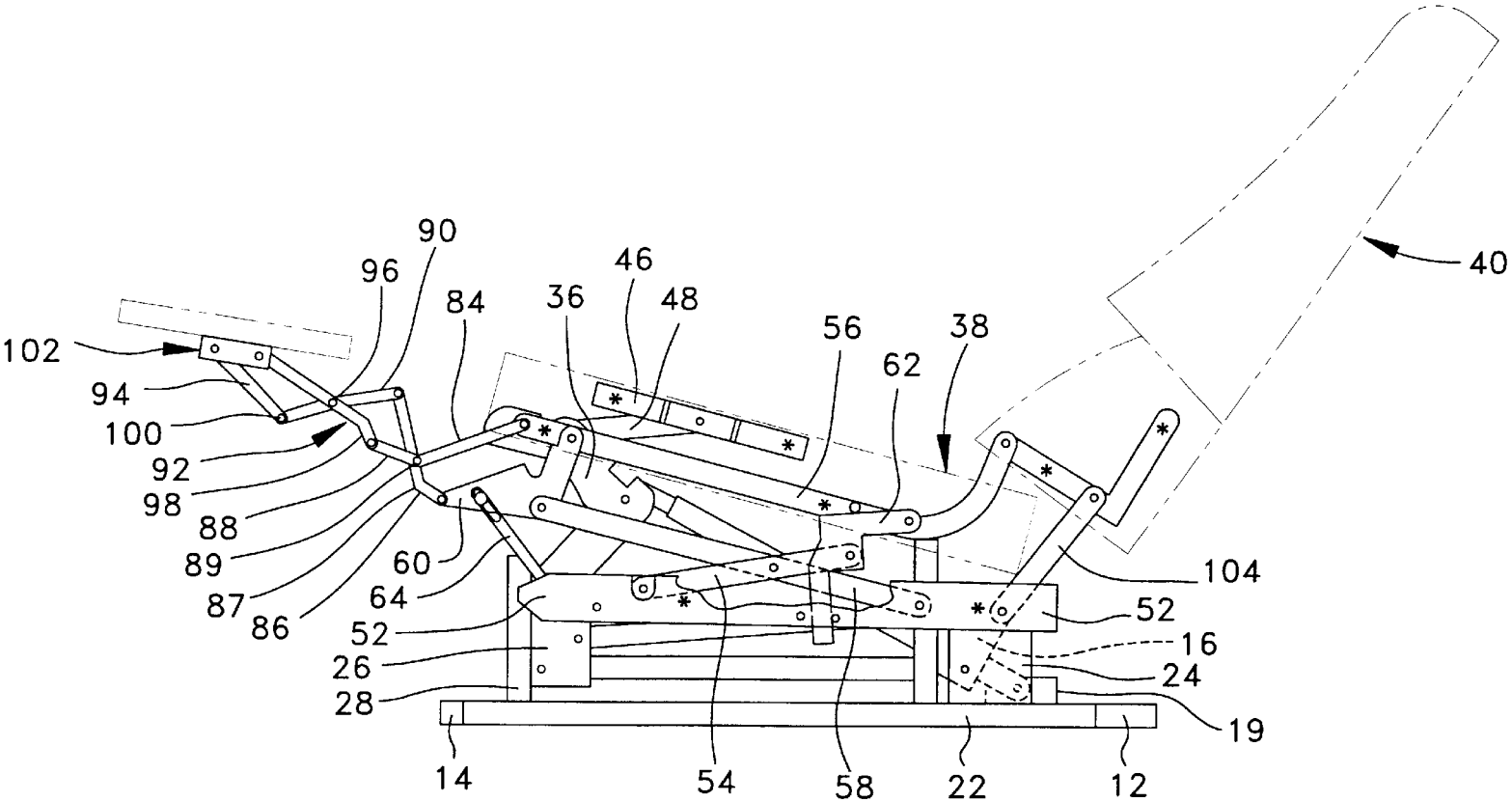
FIG. 12 is a side view of the lift chair with the chair positioned as shown in FIG. 8 and with certain additional portions of the chair mechanism illustrated.
Figure 13:
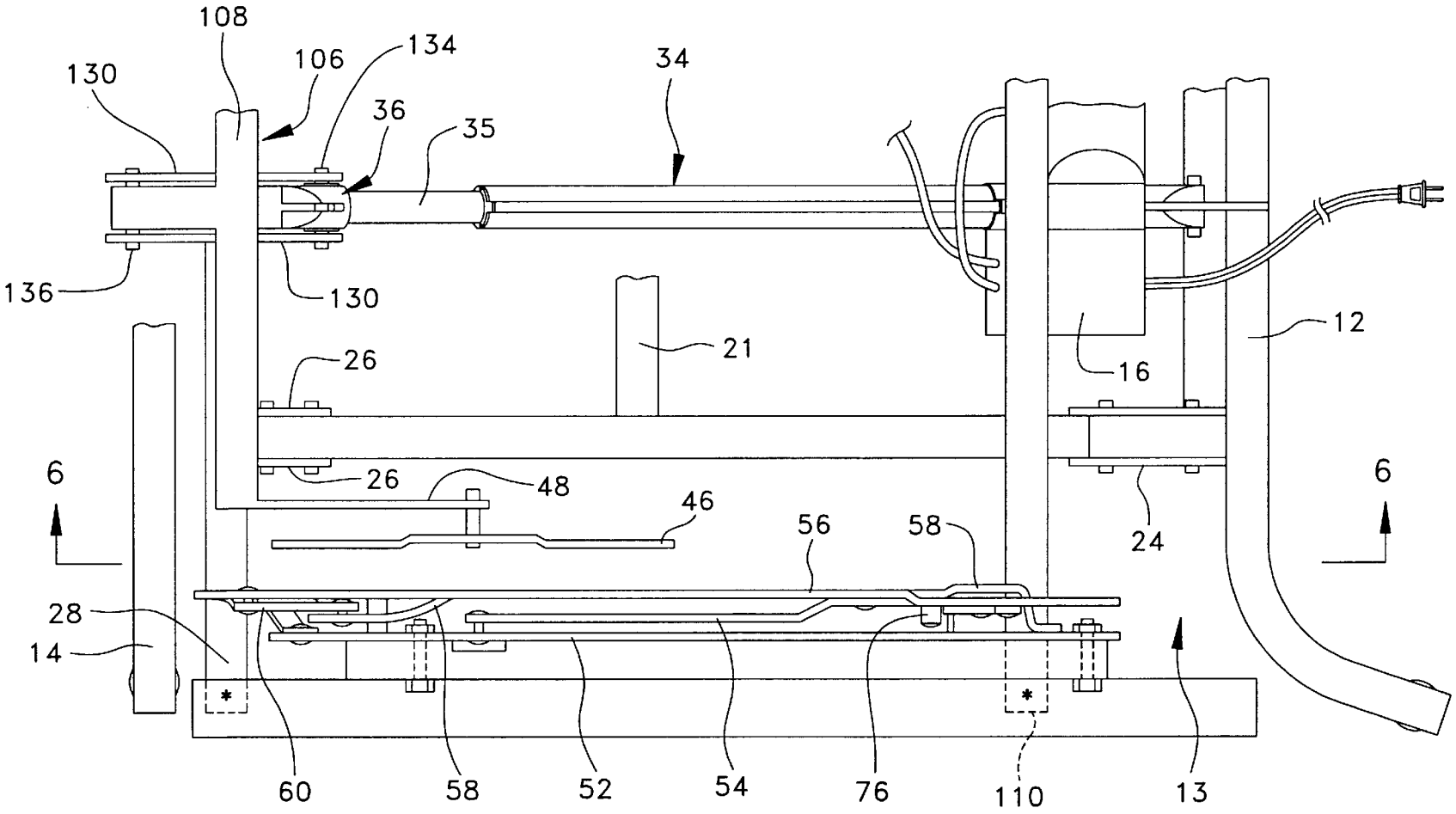
FIG. 13 is a top view of a portion of the chair lift mechanism and with the lift chair in the position illustrated in FIGS. 6 and 11.
Figure 14:
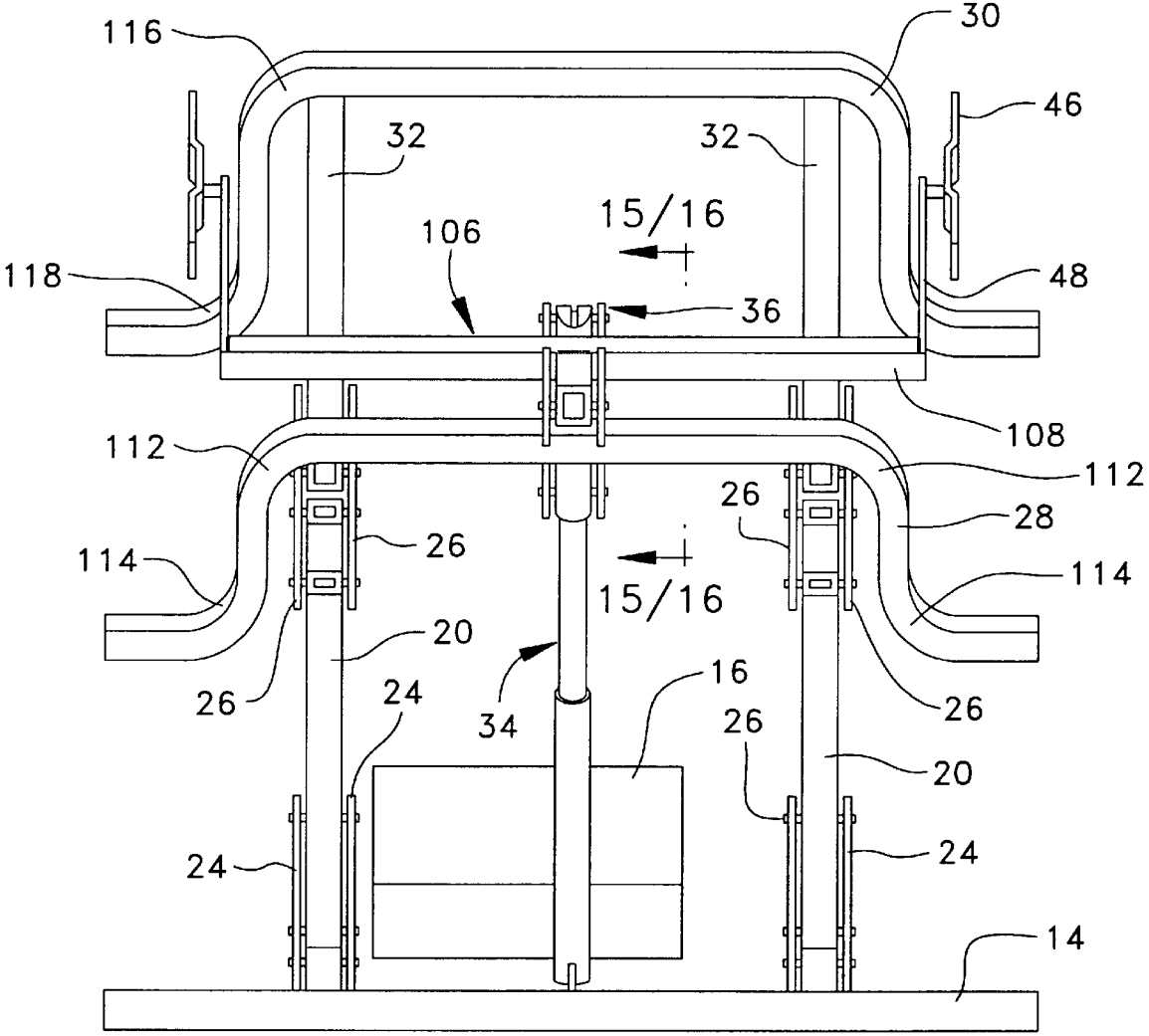
FIG. 14 is a front view of a portion of the chair lift mechanism with the lift chair in the fully raised position illustrated in FIG. 10 and in FIG. 19 and depicted schematically to FIG. 5.
Figure 24:
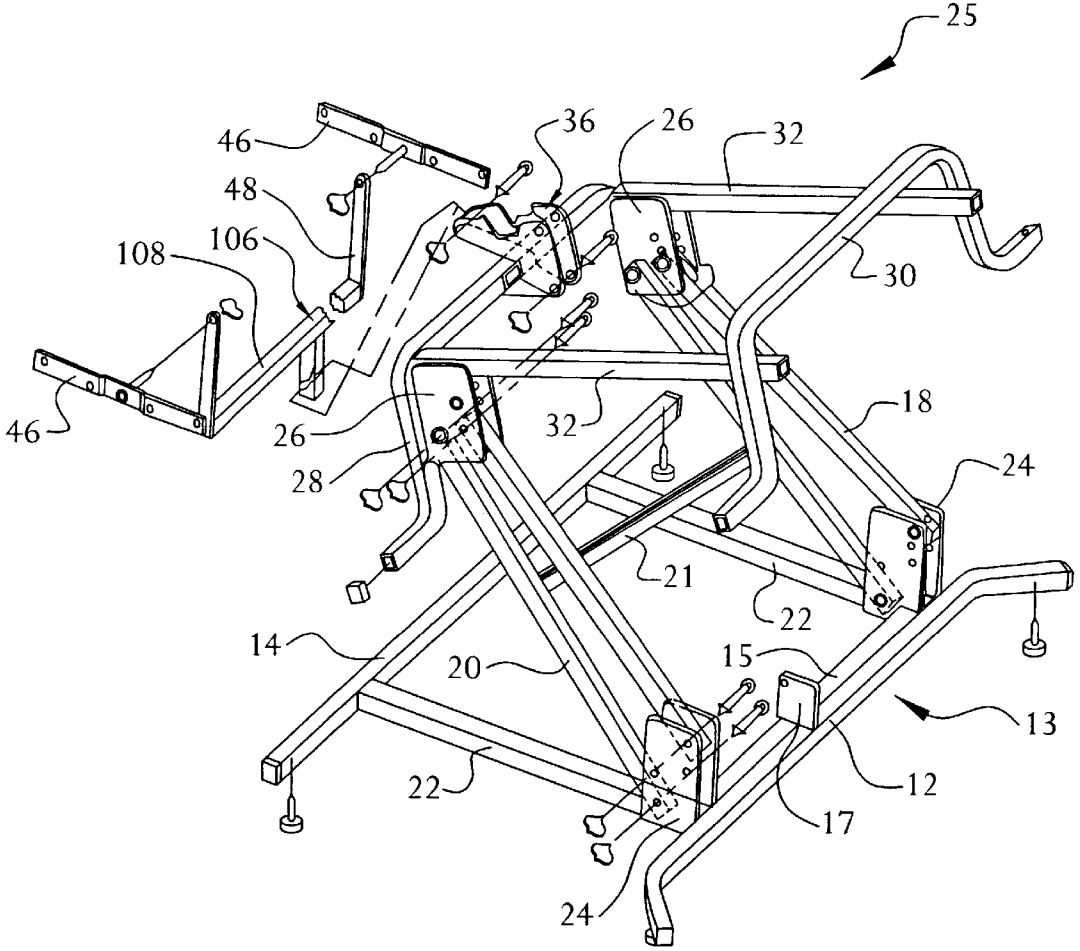
FIG. 24 is an isometric view, partially broken, of a portion of the lift chair mechanism depicted in FIGS. 6 through 23.
Figure 25:
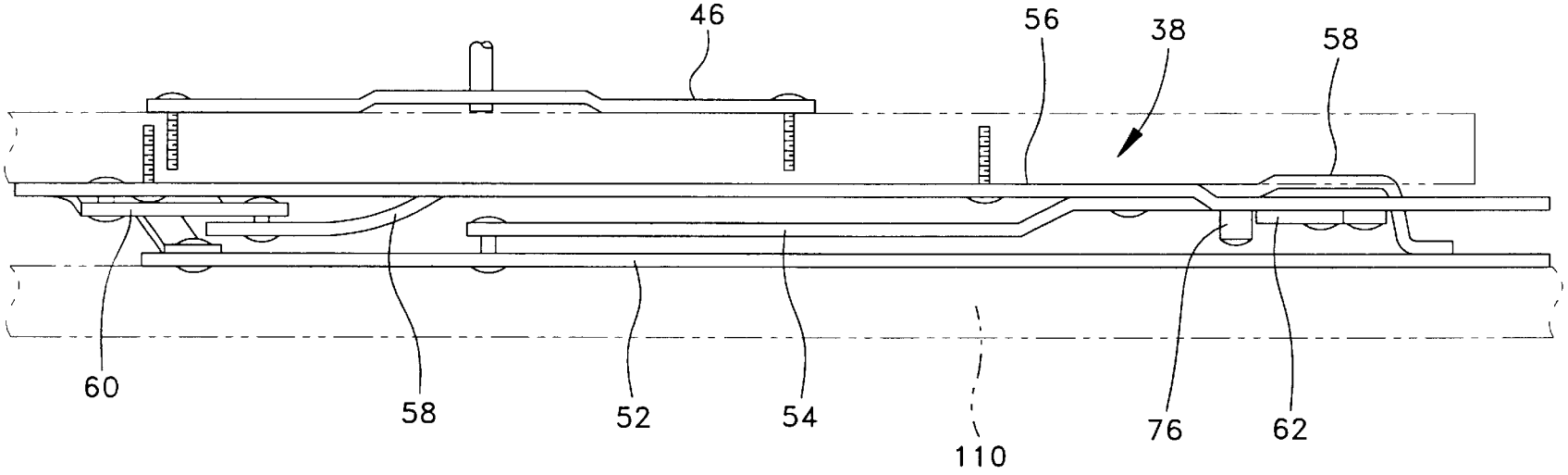
FIG. 25 is a sectional view looking downwardly, taken at the position of arrows 25—25 in FIG. 11.

Lift chair 10 includes a frame designated generally 13 in FIGS. 6, 13 and 24 with frame 13 including a rear frame base rail designated generally 12 and a front frame base rail designated 14 in FIGS. 6, 13, 14 and 24. Extending along rear frame base rail 12 parallel thereto and in complemental contact therewith is a frame support member 15 best seen in FIG. 24. Rear frame base rail 12 and frame support member 15 together support a base frame motor mounting plate 17, best seen in FIG. 24, to which a motor assembly designated generally 16 and best seen in FIGS. 12, 13, 14 and 18 is mounted.

Figure 11:
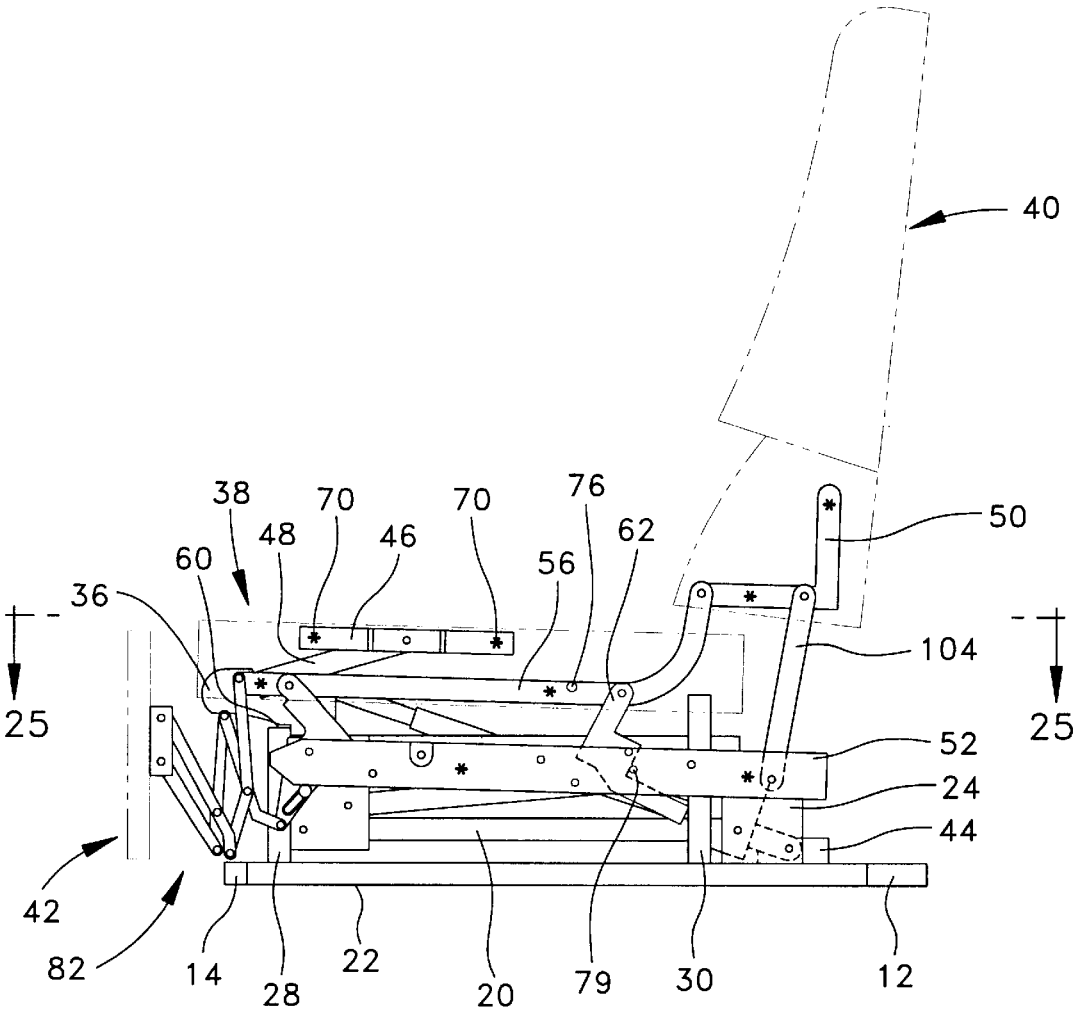
FIG. 11 is a side view of a lift chair embodying the invention, with the chair positioned as shown in FIG. 6 and with certain additional portions of the lift chair mechanism illustrated.

A pair of side frame base rails are transversely spaced from one another and extend longitudinally between and structurally connect front and rear frame base rails 14, 12 as illustrated in FIGS. 6 and 11 and as perhaps best visible in FIG. 24. Frame base rails 12, 14 and 22 are preferably welded one to another to provide a strong support structure as a part of the lift chair frame supporting lift mechanism 11 and lift chair 10.

Two pairs of rear frame side plates 24 are positioned at the respective junctures of rear frame base rail 12 with side frame base rails 22. Each of the rear frame side plates 24 are preferably welded to the associated side frame base rail 22 with rail 22 sandwiched between the pair of plates and are further preferably welded to frame support member 15 at the points of contact therewith as illustrated in FIG. 24.

A pair of elevator arms are pivotally mounted to and retained between each pair of rear frame side plates 24 where the upper more of the two elevator arms is designated 18 and the lower of the two elevator arms is designated 20. Elevator arms 18, 20 are preferably disposed in pairs, between respective pairs of rear frame side plates 24 as illustrated in FIG. 24. One pair of elevator arms 18, 20 is shown in FIG. 6 and the drawing figures similar thereto.

The chair lift mechanism preferably further includes a chair elevator frame designated generally 25 in FIG. 24. Chair elevator frame 25 preferably includes a front elevator frame cross-member designated generally 28, a rear elevator frame cross-member designated generally 30 and a pair of transversely spaced apart longitudinally extending elevator frame side members 32. Front and rear elevator frame cross-members 28, 30 and the pair of elevator frame side members 32 are all preferably welded together to provide a rigid structure as a portion of chair elevator frame 25 for the lifting operation of lift chair 10.

Referring to the drawings in general and to FIGS. 11, 12, 13, 21 and 22 in particular, a first longitudinal bar 52 is secured to an upstanding portion of the chair, which is preferably a wood portion, by screws denoted by asterisks in FIG. 11 and identified as screws 66.

In the drawings, particularly in FIGS. 11, 12, 13, 21 and 22, a second generally longitudinal bar 54 is pivotally movably connected to first generally longitudinal bar 52 as illustrated generally in FIG. 13. Second generally longitudinal pivotally movable bar 54 extends rearwardly from the position of pivotal connection with first longitudinal bar 52, as illustrated in FIGS. 12, 13, 21 and 22, and includes an offset 68 located about at the longitudinal midpoint of second generally longitudinal pivotally movable bar 54.

A fourth generally longitudinal pivotally movable bar 58, as illustrated in FIG. 13, is pivotally connected to first longitudinal bar 52 proximate the rear end thereof and is pivotally connected to a first generally vertical pivotally movable bar 60 at the front end thereof as illustrated in FIG. 12. Fourth generally longitudinal pivotally movable bar 58 includes an inward offset to provide some clearance for what is a pivotal connection between the end of second generally longitudinal pivotally movable bar 54 and a central portion, where there is a central pivotal connection with fifth generally vertical pivotally movable bar 60, which pivotal connection is illustrated in FIG. 12 in dotted lines and in solid lines in FIG. 21.

A third longitudinal bar 56 is fixed to the chair seat portion designated generally 38 which supports the chair occupant. Third longitudinal bar 56 is retained in place respecting seat portion 38 by screws designated 70 in the drawing figures.

Figure 21:
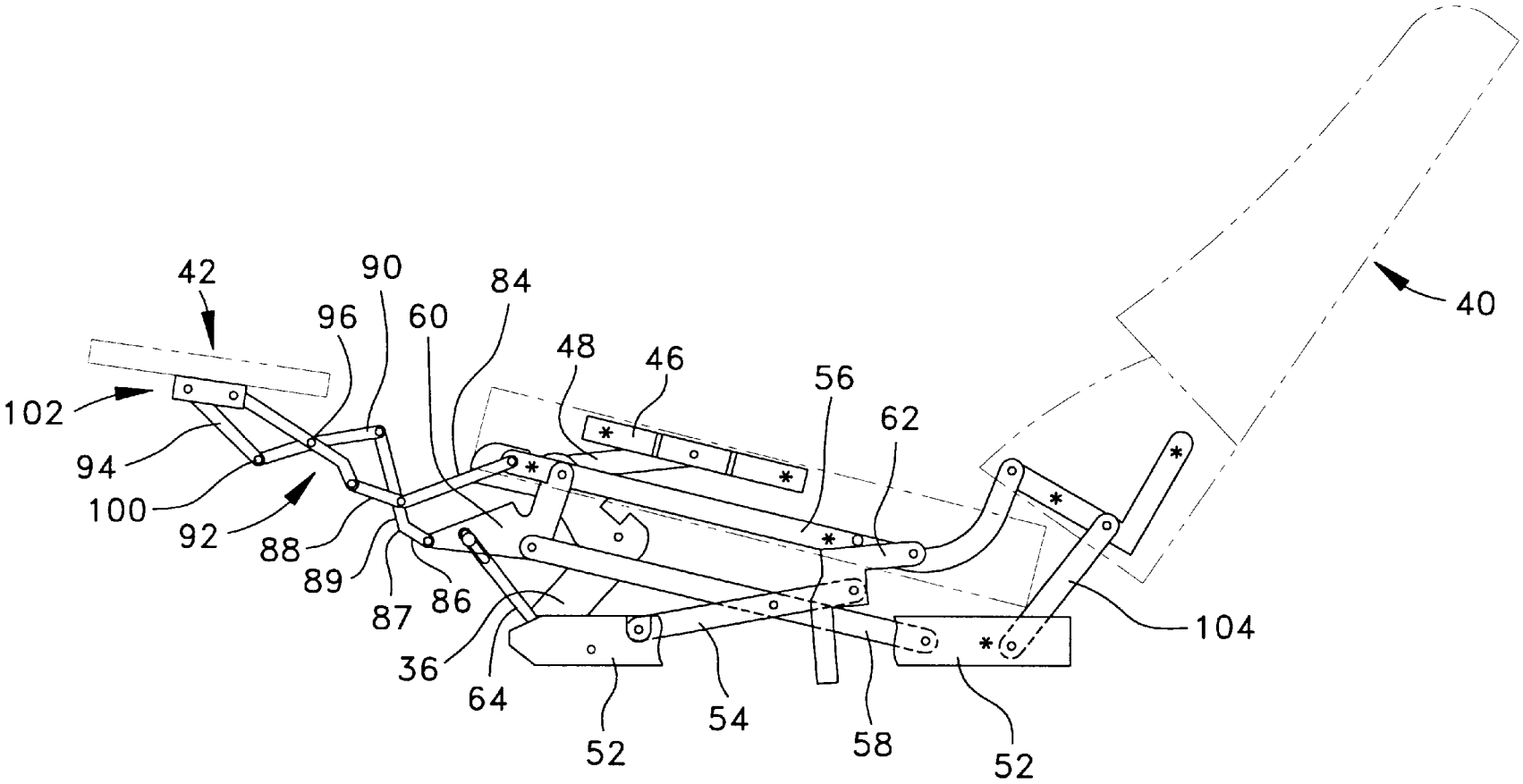
FIG. 21 is a side view of the lift chair corresponding generally to FIG. 20 but illustrating the lift chair in the reclined position.

A fifth generally vertical pivotally movable bar 60 is pivotally connected to third longitudinal bar 56 as illustrated in FIGS. 11, 12, 21 and other drawing figures. Fifth generally vertical pivotally movable bar 60 is also pivotally connected to fourth generally longitudinal movable bar 58 as further illustrated in FIG. 12. Fifth generally vertical pivotally movable bar 60 includes a pin, which has not been numbered in the drawings, extending transversely from fifth generally vertical pivotally movable bar 60 and engaging a slot, which also has not been numbered in the drawings, formed in a slotted seventh bar designated generally 64 in FIGS. 12 and 21. Fifth generally vertical pivotally movable bar 60 includes an offset 72 formed in the portion of bar 60 from which the unnumbered pin extends and engages the unnumbered slot in slotted seventh bar 64. Bar 60 includes an offset in the portion of bar 60 from which the unnumbered pin extends which engages the unnumbered slot in slotted seventh bar 64.

As illustrated in FIGS. 11, 12 and 21, sixth generally vertical pivotally movable bar 62 is pivotally connected to third longitudinal bar 56 at a pivotal connection denoted 74 in the drawings. Sixth generally vertical pivotally movable bar 62 is also pivotally connected to second generally longitudinal pivotally movable bar 54 at the end of bar 54 oppositely from where bar 54 is pivotally connected to first longitudinal bar 52. The pivotal connection between sixth generally vertical pivotally movable bar 62 and second generally longitudinal pivotally movable bar 54 is denoted 78 in the drawings. The central portion of second generally longitudinal pivotally movable bar 54 is pivotally connected to fourth generally longitudinal pivotally movable bar 58 with such connection being at the central portion of second generally longitudinal pivotally movable bar 54 and with the point of connection therebetween being designated 80 in the drawings.

Slotted seventh bar 64 is pivotally connected to the front end of first bar 52 and extends away therefrom. Slotted seventh bar 64 includes a slot, which has not been numbered in the drawings, receiving the head of a pin connection extending from fifth generally vertical pivotally movable bar 60. The pin/slot connection arrangement is illustrated in FIG. 11 and is more visible in FIGS. 12 and 21, due to the movable leg support 42 being extended.

The chair movable leg support designated generally 42 is connected to a chair lift mechanism designated generally 11 as illustrated in FIGS. 11, 12 and 21 by a scissors-type linkage mechanism designated generally 82 in FIGS. 11, 12 and 21.

As best illustrated in FIGS. 12 and 21, scissors-type linkage mechanism 82 includes a first link 84 which is generally straight and disposed in a longitudinal plane respecting the remainder of the lift chair mechanism, where first link 84 is pivotally connected at its rear (in FIGS. 12 and 21) or upper (in FIG. 11) extremity to the front extremity of third longitudinal bar 56, which is fixed to the seat portion of the lift chair.

Scissors-type mechanism 82 further includes a second link 86 which preferably has a knee formed therein designated 87 in FIG. 12. Second link 86 is pivotally connected at the extremity of the shorter leg of second link 86 to an extremity of fifth generally vertical pivotally movable bar 60.

Scissors-type linkage mechanism 82 further includes a third link 88 which is pivotally connected at its rear (in FIGS. 12 and 21) extremity to the forward extremity (in FIGS. 12 and 21) of first link 84, with such point of pivotal connection between third link 88 and first link 84 being designated 89. Pivotal connection 89 of first and third links 84, 88 also passes through the longer leg of second link 86 and provides a pivotal connection between first and third links 84, 88 and second link 86, respectively defining the arms of the scissors, providing scissors-type action of linkage mechanism 82.

Linkage mechanism 82 further includes a fourth link 90 which is pivotally connected to second link 86 at the extremity of link 86 opposite from the point of connection of link 86 with fifth generally vertical (in FIG. 11) pivotally movable bar 60.

Scissors-type linkage mechanism 82 yet further includes a fifth link designated generally 92 in FIGS. 12 and 21 pivotally connected at its rear end (in FIGS. 12 and 21) to third link 88 and pivotally connected at a central position with a central portion of fourth link 90. The pivotal connection of fifth link 92 with fourth link 90 and fifth link 92 is designated 96 in FIG. 12 and in FIG. 21. Fifth link 92, similarly to second link 86, has a knee formed therein; the knee of fifth link 92 has been designated 98 in FIG. 12 and in FIG. 21.

Scissors-type linkage mechanism 82 yet further includes a sixth link 94 which is pivotally connected to fourth link 90 at the extremity of fourth link 90 remote from pivotal connection of fourth link 90 with second link 86. The point of pivotal connection between sixth link 94 and fourth link 90 is designated 100 in FIG. 12.

Scissors-type linkage mechanism 82 in general and specifically fifth and sixth links 92, 94 are pivotally connected to a chair leg support mounting bracket 102 which in turn is secured to the movable leg support designated generally 42 by suitable screws or other fastening means not illustrated in the drawings. Pivotal connections of fifth and sixth links 92, 94 to chair leg support mounting bracket 102 are separate one from another in the vertical direction when the scissors-type linkage mechanism designated generally 82 is in the folded position, with the chair movable leg support in a substantially vertical disposition as illustrated in FIG. 11.

Respecting operation of lift chair 10, considering lift chair 10 in the standard or starting "sitting" position with chair movable leg support 42 in a vertical position, scissors-type linkage mechanism 82 retracted, chair back portion 40 in a generally upright position and tilted slightly to the rear for occupant comfort, with chair seat portion 38 tilted slightly from front to back for comfort in the manner of a conventional living room chair, this configuration is illustrated in FIGS. 6, 11, 18, 20 and 23.

In FIG. 11, there is shown a pin denoted 79 which serves as the stop for sixth bar 62 when lift chair 10 is shifted into motion to lift and tilt, specifically as sixth bar 62 rotates counterclockwise about the point of pivotal connection with second bar 54 as chair seat portion 38 portion is moved forward due to extension of the motor shaft extension portion causing rotation of bell crank 36 counterclockwise in FIGS. 11 and 12. Chair seat portion 38 portion of lift chair 10 moves towards the front of lift chair 10, and sixth bar 62 contacts pin 79 illustrated in FIG. 11 which stops the forward movement of seat portion 38 of lift chair 10. That contact preferably occurs essentially simultaneously with bell crank 36 contacting the front elevator frame cross-member 28.

Figure 22:
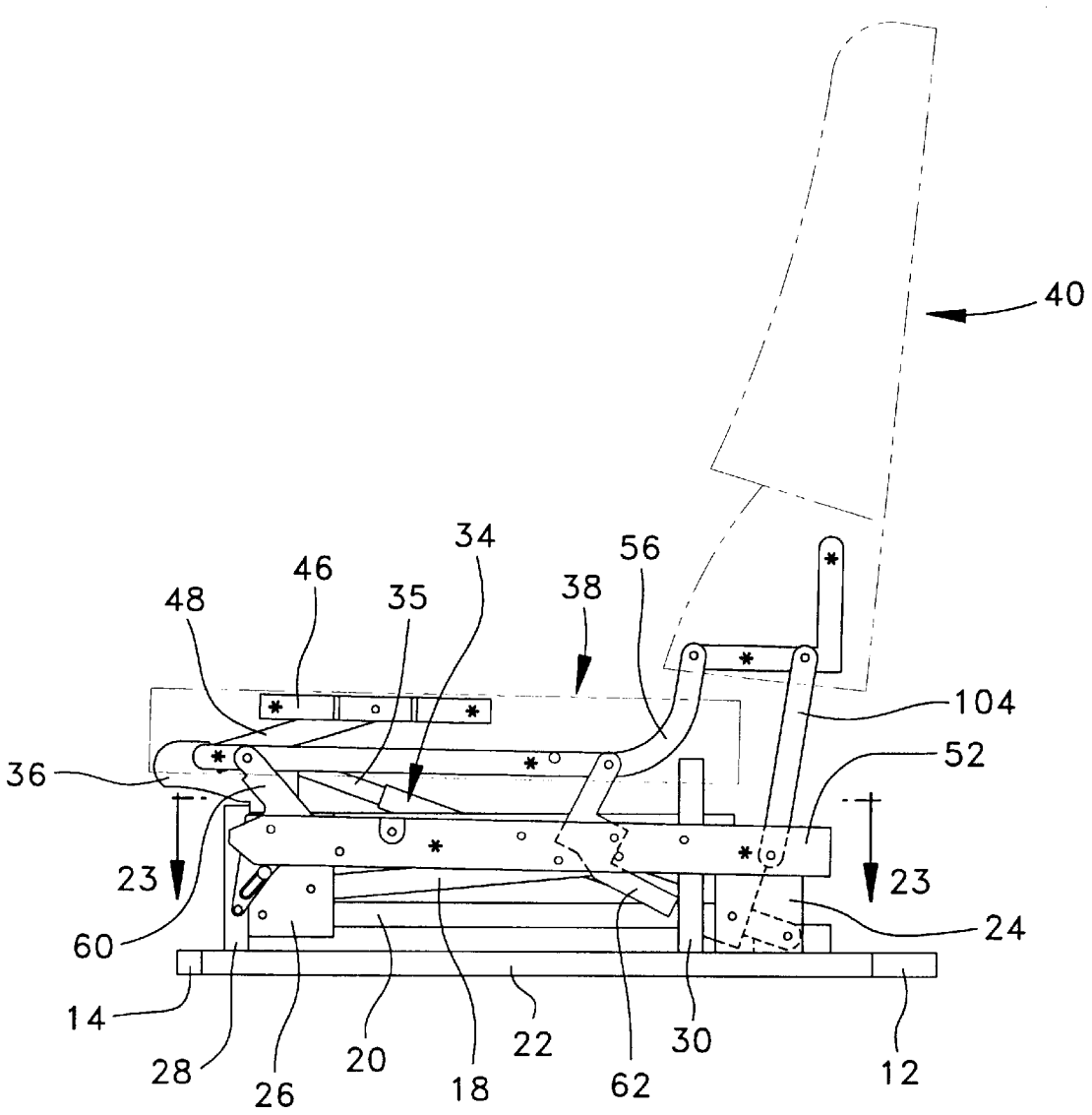
FIG. 22 is a side elevation of a lift chair embodying the invention, with the lift chair seat and back portions at the position illustrated in FIGS. 6, 11 and 17, but with the leg support and associated actuating structure not shown to facilitate drawing clarity.
Figure 23:
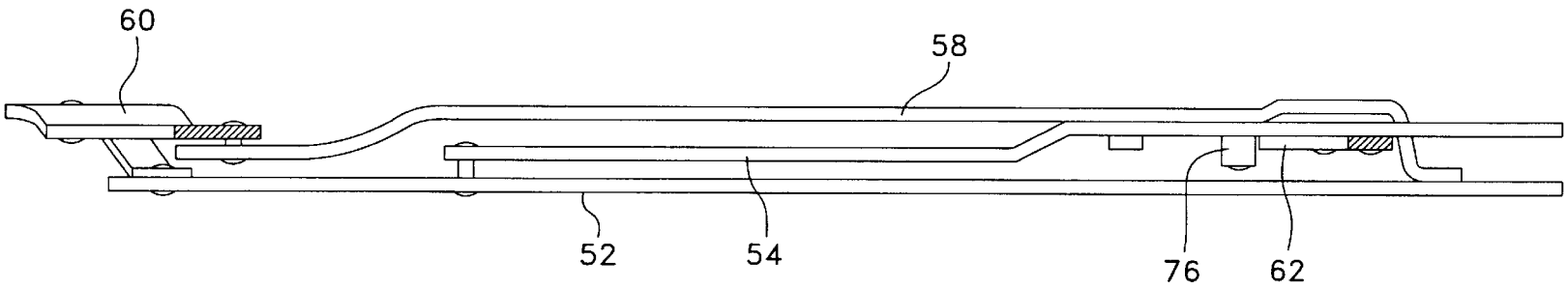
FIG. 23 is a sectional view looking downwardly as indicated by arrows 23—23 in FIG. 22.

At the initial sitting position illustrated in FIGS. 6, 11 and 22, which may be characterized as the neutral position with the leg support portion 42 lowered and before any lifting of seat portion 38 has commenced, due to the sloped configuration of the bottom 140 of slot 138 in the two parallel plates 130 that define bell crank 36 and specifically bottom or lower portion 140 of slot 138 being tilted upwardly from front to rear, cross-member 108, which is a portion of T-bracket 106, rests in slot 138 and provides a slight rearward tilt for seat portion 38. Cross-member 108 has longitudinal seat support linkage bars 48 fixed securely thereto, preferably by welding. This positions longitudinal seat support linkage bars 48 extending somewhat upwardly, from front to rear, with bars 48 disposed at an angle of about 30° to the horizontal when bell crank 36 is at the position illustrated in FIGS. 6, 11 and 22.

At this neutral or starting position, the seat portion 38 is slightly sloped from front to rear to provide comfortable seating for the occupant. This positioning of seat portion 38 is also effectuated by the orientation of attachment of first longitudinal bar 52 to a wood member 110 which is affixed preferably by screws to the lower outer extremities of front and rear elevator frame cross-members 28, 30 as illustrated generally in FIG. 13.

To recline lift chair 10, the operator actuates the control so that motor 16, through the action of a worm gear affixed to the motor output shaft, and a rack within the motor extension shaft 34, causes motor extension shaft 34 to retract thereby causing bell crank 36 to rotate away from front elevator frame cross-member 28. In other words, motor shaft extension portion 35 retracts into shaft sleeve 37. As that retraction occurs, T-bracket 106 pivotally connected to bell crank 36 at the end of bell crank 36 at the forwardmost portion of lift chair 10, at the position shown in FIGS. 6, 11 and 15, rotates with bell crank 36 thereby moving seat portion 38 of chair 10 generally rearwardly and slightly upwardly.

This rearward motion carries with it third bar 56 which is fixed to chair seat portion 38 of lift chair 10 by screws indicated schematically by asterisks in the drawings. Movement of third bar 56 also causes rotation of sixth bar 62 and rotation of fifth bar 60 in the clockwise direction viewing FIGS. 11 and 12.

Figure 15:
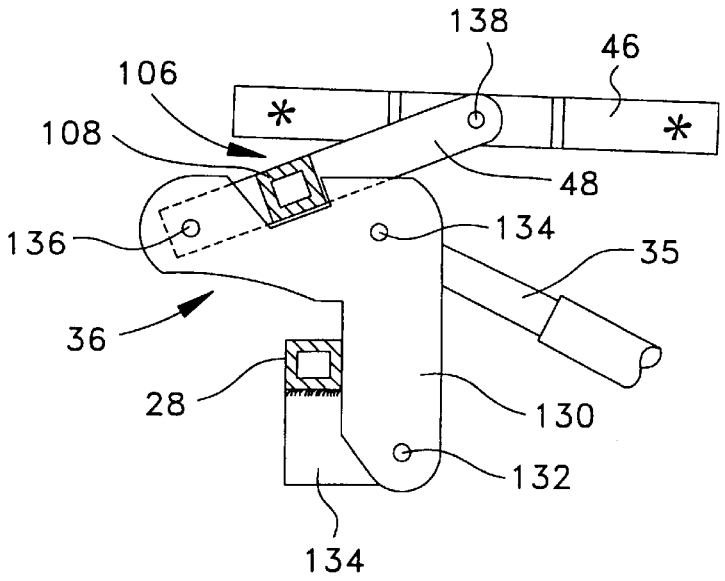
FIG. 15 is a sectional view taken at lines and arrows 15—15 in FIG. 14 showing a bell crank structure with the lift chair in the position illustrated in FIGS. 6 and 11.
Figure 16:
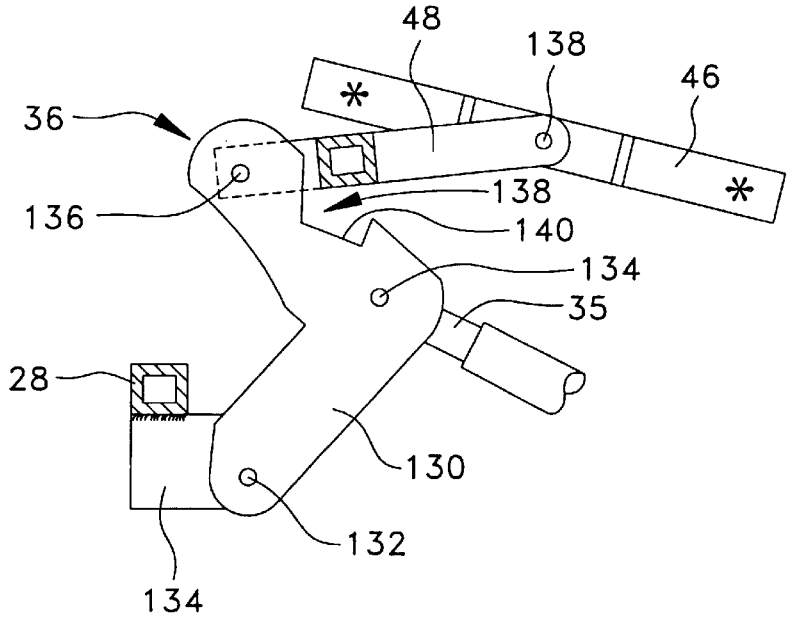
FIG. 16 is a sectional view taken at lines and arrows 15—15 in FIG. 14 showing the bell crank structure with the lift chair in the position illustrated in FIG. 7.

As seat portion 38 of chair 10 moves generally rearwardly prior to actuation of scissors linkage 82 to change the position of movable leg support 42, there is only a slight upward component of motion of seat portion 38. This results from rotation of bell crank 36 about the axis defined by the point of pivotal connection of bell crank 36 to bracket 134 which affixes bell crank 36 to front elevator frame cross-member 28 as illustrated in FIGS. 15 and 16. Upon rotation of bell crank 36 from the position illustrated in FIG. 15 to the position illustrated in FIG. 16, there is little vertical movement imparted to chair seat support brackets 46 due to the geometry of bell crank 36 and particularly because the point of pivotal connection of bell crank 36 respecting the bracket attaching bell crank 36 to front elevator frame cross-member 28 is substantially below and laterally displaced from the point of pivotal attachment of T-bracket 106 to bell crank 36.

Bell crank 36 includes two parallel plates that are preferably identical one to another with these plates being designated 130. As best illustrated in FIGS. 15 and 16, bell crank 36 has generally a triangular configuration with the triangle preferably being a right triangle and generally of the "three-four-five" configuration. In that regard, bell crank 36 further preferably includes a pin 132 serving as a pivotal connection between bell crank 36 and a bracket 134 which is fixedly attached, preferably by welding, to front elevator frame cross-member 28 shown in section in FIGS. 15 and 16.

Bell crank 36 further includes a second pin 134 providing a pivotal connection between bell crank 36 and motor extension shaft portion 35. Bell crank 36 yet further includes a third pin 136 providing a pivotal connection between bell crank 36 and T-bracket 106, specifically the leg portion thereof, as illustrated in FIGS. 15, 16 and 24.

T-bracket 106 includes cross-member 108 illustrated in section in FIGS. 15 and 16 with third pin 136 providing the pivotal connection between bell crank 36 and T-bracket 106. Also shown in FIG. 15 are longitudinal seat support linkage bars 48 which are fixedly secured to cross-member 108 of T-bracket 106, preferably by welding, and chair seat support brackets 46 which are pivotally connected to longitudinal seat support linkage bars 48 via pins 138. Asterisks on chair seat support brackets 46 in FIGS. 15 and 16 denote the points of screw connection of chair seat support brackets 46 with the wood framing of the chair, particularly of the chair seat portion 38.

Bell crank 36 being configured substantially as a three-four-five right triangle, with the bell crank pivotal connections located proximate the vertices thereof, contributes to the smooth operation and secure feeling experienced by an occupant of the lift chair according to the invention. Also, bell crank 36 and its geometry contribute to the feature of the invention whereby when the motor is actuated to retract motor shaft extension portion 35 and rotate bell crank 36 from the position illustrated in FIG. 15 to the position illustrated in FIG. 16, scissors linkage mechanism 82 actuates well prior to chair back portion 40 reclining relative to chair seat portion 38.

Specifically, bell crank 36 rotates about an axis defined by pin 132 when bell crank 36 is moved by motor shaft extension portion 35. Due to the triangular configuration of bell crank 36, rotation of bell crank 36 about an axis defined by pin 132 does not result in a large vertical component of motion at pivotal connection 136 between bell crank 136 and between T-bar 108.

Most of the motion at pivotal connection 136 is lateral motion during the initial clockwise rotation (in FIGS. 15 and 16) of bell crank 36 about the pivot point defined by pin 132. This initial, largely lateral motion applied to seat portion 38 in turn effectuates movement of leg support portion 42 into the position illustrated in FIG. 17 without reclinement of chair back portion 40 relative to seat portion 38.

As bell crank 36 continues to rotate in the clockwise direction illustrated in FIG. 16, due to continued retraction of motor shaft extension portion 35, pivotal connection 136 is moved in a more vertical direction thereby actuating the bar linkage mechanism which effectuates the recline function and specifically tilting of chair back portion 40 relative to chair seat portion 38.

In the position illustrated in FIG. 15 where bell crank 36 is in abutting relationship with front elevator frame cross-member 28, pins 134, 136 are essentially aligned horizontally, with pin 132 being essentially vertically immediately below pin 134.

Further respecting the geometry of the bell crank and the three-four-five right triangle configuration, the three-side of the triangle is between pin connections 136 and 134, the four-side of the triangle is between pin connections 132 and 134 and the five-side or the hypotenuse is between pin connections 136 and 132.

Figure 17:
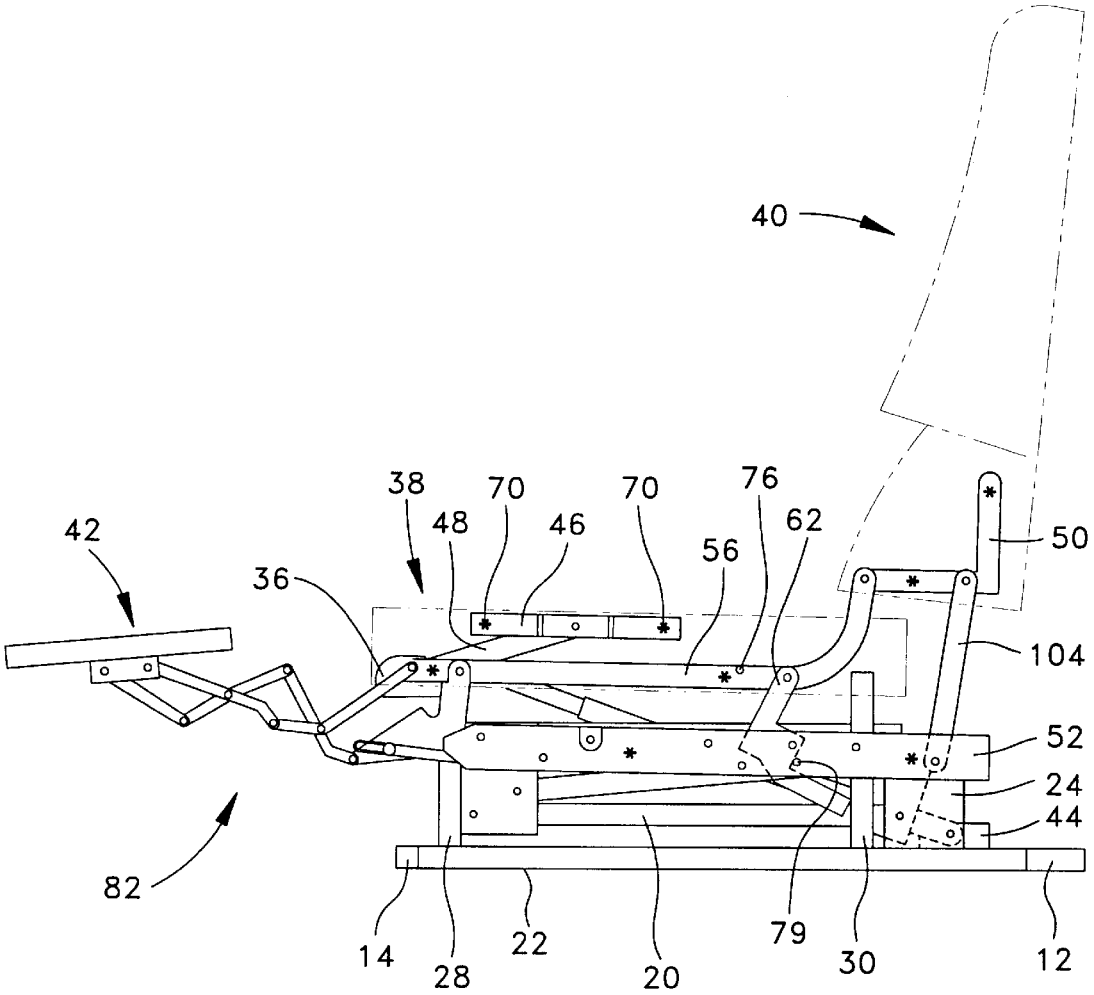
FIG. 17 is a side view of a lift chair embodying the invention, showing the chair parts in a similar fashion to FIGS. 11 and 12 and with the lift chair in the position at which the movable leg support is fully extended to support the occupant's legs and feet but at which the chair has not reclined from the conventional seating position illustrated in FIG. 6 and FIG. 11.

There is slight rearward motion of third bar 56 during movement of the chair seat portion 38 from the neutral or sitting position into the "television" position, at which leg support portion 42 has been raised into the position illustrated in FIG. 17. At this position, chair back portion 40 has not begun to recline. As chair seat portion 38 moves generally rearwardly and carries with it third longitudinal bar 56, this results in rotation of fifth and sixth pivotally movable bars 60 and 62. This rotation results from first longitudinal bar 50 being fixedly secured to a wood member upstanding from the lateral edges of front and rear elevator frame cross-members 28, 30 and having been fixed in position relative to this portion (fifth and sixth bars 60, 62, etc.) of the lift chair linkage but, of course, is free to be lifted together with the remaining portions of the lift chair elevator frame during chair elevation.

Rearward movement of chair seat portion 38 and third longitudinal bar 56 attached thereto resulting from rotation of bell crank 36, when the chair moves from the neutral sitting position into the "television" position, produces clockwise rotation (viewing FIG. 12) of fifth pivotally movable bar 60 about its point of pivotal connection with third longitudinal bar 56. This rotation of fifth pivotally movable bar 60 together with the rearward movement of third longitudinal bar 56, actuates scissors mechanism 82 as the point of pivotal connection between second link 86 and fifth pivotally movable bar 60 moves forward and the point of pivotal connection between first link 84 and third longitudinal bar 56 moves rearwardly. Additionally, the point of pivotal connection between second link 86 and fifth pivotally movable bar 60 moves closer to the point of pivotal connection of first link 84 with third longitudinal bar 56, due to the rotary motion of fifth pivotally movable bar 60 about its point of pivotal connection with third longitudinal bar 56. Rotation of fifth pivotally movable bar 60 in the clockwise direction about its point of pivotal connection with third longitudinal bar 56 continues as chair seat portion 38 moves rearwardly thereby actuating scissors mechanism 82 and putting chair movable leg support portion 42 into a horizontal or slightly above horizontal disposition illustrated in FIG. 12.

Clockwise rotation of fifth bar 60 causes the extremity of fifth bar 60 which is connected to the first link of scissors mechanism 82 to move forwardly as fifth bar 60 moves in a clockwise direction from the position illustrated in FIG. 11 to the position illustrated in FIG. 12, causing scissors mechanism 82 to shift movable leg support 42 from the vertical disposition illustrated in FIG. 11 to the generally horizontal disposition illustrated in FIG. 12. Rearward motion of chair seat portion 38 and third bar 56 causes rotation of the pivotally connected fifth and sixth bars 60, 62 which are connected to third bar 56 and also causes some rotation of slotted seventh bar 64 due to the pin and slot action between fifth bar 60 and slotted seventh bar 64. As a result, seventh bar 64 rotates clockwise in FIGS. 11 and 12 from the position illustrated in FIG. 11 to the position illustrated in FIG. 12 due to rearward motion of chair seat portion 38. First bar 52, second bar 54 and fourth bar 58 do not move perceptibly during this initial phase of seat rearward motion from the neutral or starting "sitting" position.

As chair seat portion 38 of lift chair 10 moves rearwardly due to the rotation of bell crank 36 in a clockwise direction as viewed in FIGS. 6, 11, 15 and 16, there is also a slight raising of the forward part of chair seat portion 40 relative to the rear portion of chair seat portion 40. This results from rotation of bell crank 36 about its pivot point and the consequent slightly upward component of the movement applied to T-bracket 106 as the pivotal mounting position of T-bracket 106 to bell crank 36 travels along an arc defined by its position relative to the axis of rotation point of bell crank 36.

The lifting of the front end of fourth bar 58 pivotally connected to fifth bar 60 occurs as fifth bar 60 continues to rotate with the leg portion thereof defined by a straight line between the pivotal connection of fifth bar 60 with third longitudinal bar 56 and the point of pivotal connection between fifth bar 60 and fourth longitudinally movable bar 58 moving past the vertical position into an angled position illustrated in FIG. 12.

As chair seat portion 38 portion moves rearwardly and somewhat upwardly, sixth bar 62 continues to rotate in a clockwise direction viewing FIGS. 11 and 12, about its pivotal connection with third bar 56 until sixth bar 62 contacts a pin identified as 76 in FIG. 12. Pin 76 is fixed to third bar 56 and extends laterally therefrom. When sixth bar 62, specifically the upper edge of sixth bar 62, contacts the lower portion of pin 76, sixth bar 62 cannot further rotate relative to third bar 56 and becomes effectively fixed vis-a-vis third bar 56.

As bell crank 36 continues to rotate clockwise in FIGS. 11 and 12 and continues to raise T-bracket 106 by which bell crank 36 largely drives chair seat portion 38 of lift chair 10, sixth bar 62, being immovable with respect to third bar 56 at this position, begins to lift the rear end of second bar 54 to which sixth bar 62 is pivotally connected as illustrated in FIG. 12, causing second bar 54 to rotate about the point of pivotal connection with first bar 52. This rotation of second bar 54 causes the center portion of second bar 54 to rise somewhat thereby lifting the point of pivotal connection between second bar 54 and sixth bar 52.

As sixth bar 62 makes contact with pin 76 to start the lifting of second bar 54 and hence of the central portion of fourth bar 58, the opposite or front end of fourth bar 58, which is pivotally connected to fifth bar 60, begins to be lifted by fifth bar 60. This occurs as slotted seventh bar 64 reaches the horizontal position in its rotation, as the unnumbered pin connection between slotted seventh bar 64 and fifth bar 60 moves along the slot in slotted seventh bar 64. The relative motion between slotted seventh bar 64 and fifth bar 60 is a rotary motion until slotted seventh bar 64 reaches the horizontal position. There is no longitudinal motion or movement of the unnumbered pin in the slot in slotted seventh bar 64 until slotted seventh bar 64 reaches that horizontal position. Once seventh bar 64 reaches the horizontal position, there is a vertical component as fifth bar 60 continues to try to rotate relative to third bar 56; this vertical component contributes to the lifting of fourth bar 58 and continued rotation of slotted seventh bar 64.

Once slotted seventh bar 64 reaches a horizontal position due to the pin connection between slotted seventh bar 64 and fifth bar 60, the slot in seventh bar 64 permits the pin connection with fifth bar 60 to move forwardly in the slot as the lift chair continues to recline with the chair seat portion 38 moving rearwardly due to continued rotation of bell crank 36 as bell crank 36 moves away from front elevator frame cross-member 28. Chair seat portion 38 tilts even more, going to a fully-reclined position as continued rotation of bell crank 36 urges longitudinal seat support linkage bars 48 towards the rear and upwards with chair seat support brackets 46 rising as a result and carrying chair seat portion 38 therewith. This occurs as the continued rearward motion applied to chair seat portion 38 by chair seat support brackets 46 through the rotation of bell crank 36 causes fourth longitudinally movable bar to pivot about its point of pivotal connection with first longitudinal bar 52 and further causes pivotal movement between second longitudinal bar 54 and fourth longitudinal bar 58 effectively lengthening the linkage connection between third longitudinal bar 56, at the point of pivotal connection thereof with sixth pivotally movable bar 62, and fourth longitudinal pivotally movable bar 58. In other words, once rotation of sixth pivotally movable bar 62 is precluded by contact thereof with pin 76 protruding from third longitudinal bar 56, rearward movement of third longitudinal bar 56 due to the continued rotation of bell crank 36, which rear longitudinal movement has been accommodated by rotation of third longitudinal bar 56 about sixth pivotally movable bar 62, can no longer be accommodated by pivotal movement of sixth pivotally movable bar 62 because bar 62 has become immovable with respect to third longitudinal bar 56 to the extent sixth bar 62 would attempt to further rotate in a clockwise direction as illustrated in FIG. 12.

Once sixth bar 62 contacts pin 76 that protrudes from third bar 56, sixth bar 62 is precluded from further rotation relative to third bar 56. As T-bracket 106 continues moving with bell crank 36 causing the rearward and somewhat upwardly movement of lift chair 10 seat, the linkage, which may be considered as a hybrid four bar linkage then defined by third bar 56, sixth bar 62, second bar 54, fourth bar 58 and fifth bar 60, operates to lift seat portion 38 of lift chair 10. Specifically, as T-bracket 106 continues to apply rotary and rearwardly motion to seat portion 38 because sixth bar 62 cannot further rotate relative to third bar 56, sixth bar 62 being pivotally connected to second bar 54, which is in turn pivotally connected to fixed first bar 52, rotates second bar 54 about its pivotal connection with first bar 52 thereby causing the central portion of fourth bar 58 to rise vertically. Second bar 54 is caused to rotate in a counter-clockwise direction considering FIG. 12 about the point of connection between second bar 54 and first bar 52. This results from continued rotation of bell crank 36; T-bracket 106 applies this rotary motion to the seat portion 38 of lift chair 10. The motion is still towards the rear, to the right in FIGS. 11 and 12. This motion moves the point of pivotal connection between third bar 56 and sixth bar 62 to the right in FIGS. 11 and 12, towards the rear of lift chair 10.

The contact between sixth bar 62 and pin 76 protruding from third bar 56 occurs when bell crank 36 has rotated approximately 30° from the vertical. At this position, the motion of T-bracket 106 still has a vertically upward component to it as well as a rearward component. That motion is applied to the linkage defined by bars 56, 62, 58, 54, 52 and 60 by the fixed movement of third bar 56 with chair seat portion 38 of lift chair 10 as third bar 56 moves rearwardly and somewhat upwardly as a result of the movement of T-bracket 106. The scissors action at the pivotal connection between second bar 54 and fourth bar 58 approximately at the center of second bar 54 provides further upward movement for chair seat portion 38. This applies an additional lift component to chair seat portion 38.

The suddenly immovable disposition of sixth bar 62 with respect to third bar 56 actuates a second scissors linkage defined by the pivotal connection between second bar 54 and fourth bar 58 proximate the midpoints thereof. This permits the linkage defined by third longitudinal bar 56, sixth pivotally movable bar 62, second pivotally movable bar 54, fourth longitudinal pivotally movable bar 58 and fifth pivotally movable bar 60 to rise as the chair seat portion is lifted due to operation of the bell crank 56 and as fourth longitudinal bar 58 remains pivotally connected to immovable first bar 52. The scissoring action of second bar 54 and fourth bar 58 facilitates the rearward tilting of the linkage defined by bars 56, 62, 58, 54 and 60, yet maintains a stable connection between the linkage and the seat portion with first bar 52 due to the pivoting action of second bar 54. Continued rotation of the bell crank 36 in the clockwise direction in FIG. 12 serves to drive seat portion 38 upwardly and rearwardly thereby putting the chair into the recline position.

As bell crank 36 rotates, the continuing rearward movement of third longitudinal bar 56 and especially the curved extremity thereof, which is pivotally connected to chair back portion 40 as illustrated in FIG. 12, causes chair back portion 40 to recline or tilt towards the rear with chair back portion 40 being retained in connection with the remainder of the lift chair apparatus by base-back connection bar 104 which is pivotally connected to a stationary bar affixed to the chair back and to first bar 52 as illustrated in FIG. 12.

While all of this is going on, the chair back portion 40 is reclining as a result of the pivotal connection of third bar 56 to back portion 40 and the separate pivotal connection by bar 104 from back portion 40 to first bar 52 which is, of course, immovable. Hence, as third bar 56 moves rearwardly and upwardly, the point of pivotal connection of third bar 56 to back portion 40 moves rearwardly and upwardly, and back portion 40 thereby pivots about the point of connection between bar 104 and back portion 40, thereby causing back portion 40 to recline.

To move the lift chair back portion 40 from the recline position to the upright, television viewing position and then to fold the chair movable leg support 42 from the upright horizontal support position to the essentially vertical position extending downwardly from chair seat portion 38, the sequence of bar movements recited above responsively to rotation of bell crank 36 is reversed by reversing motor 16 and extending shaft extension portion 35 to rotate bell crank 36 towards front elevator frame cross-member 28.

Figure 9:
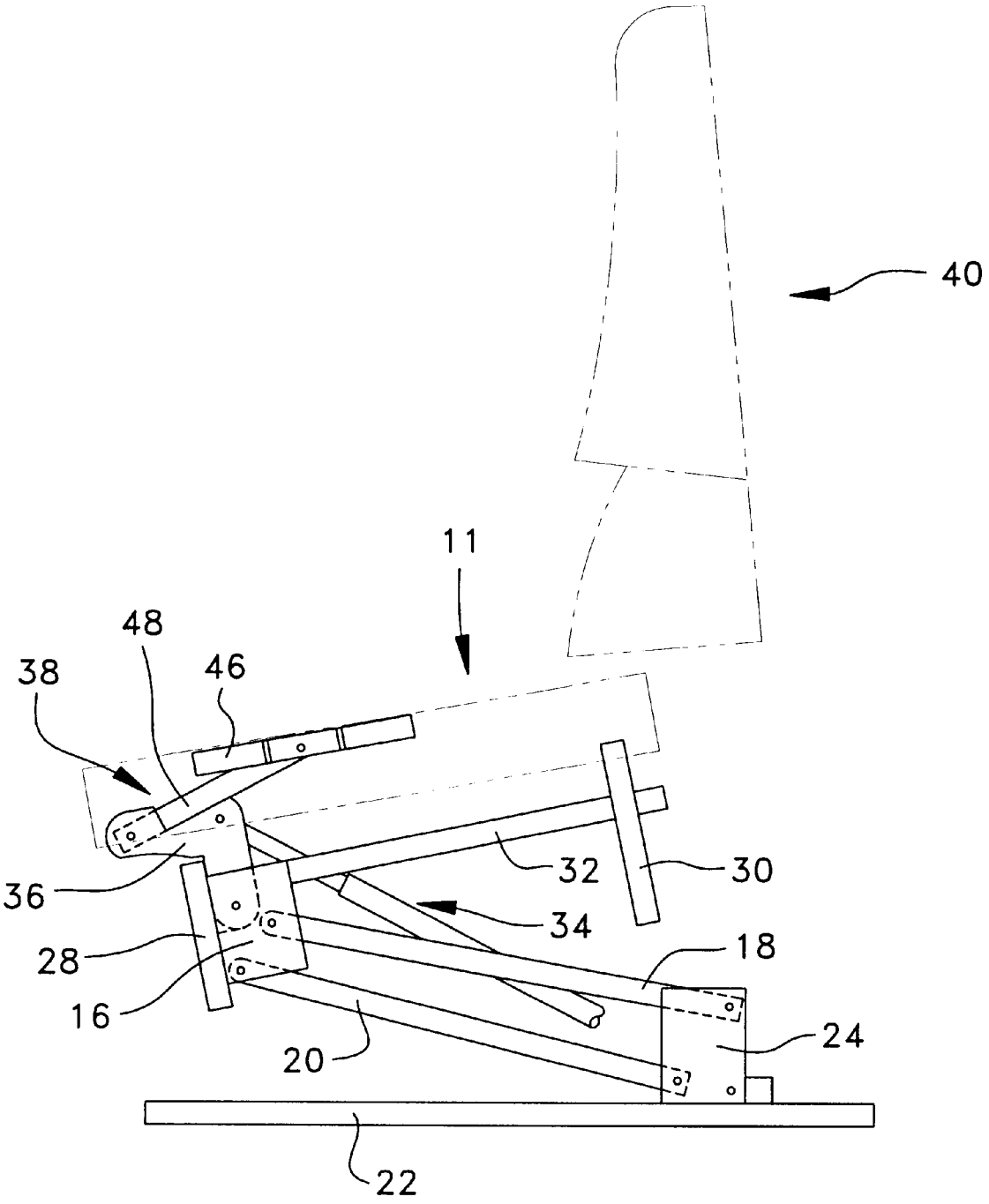
FIG. 9 is an interior side view similar to and taken at the same position as FIGS. 6, 7 and 8 but with the lift chair partly raised.
Figure 10:
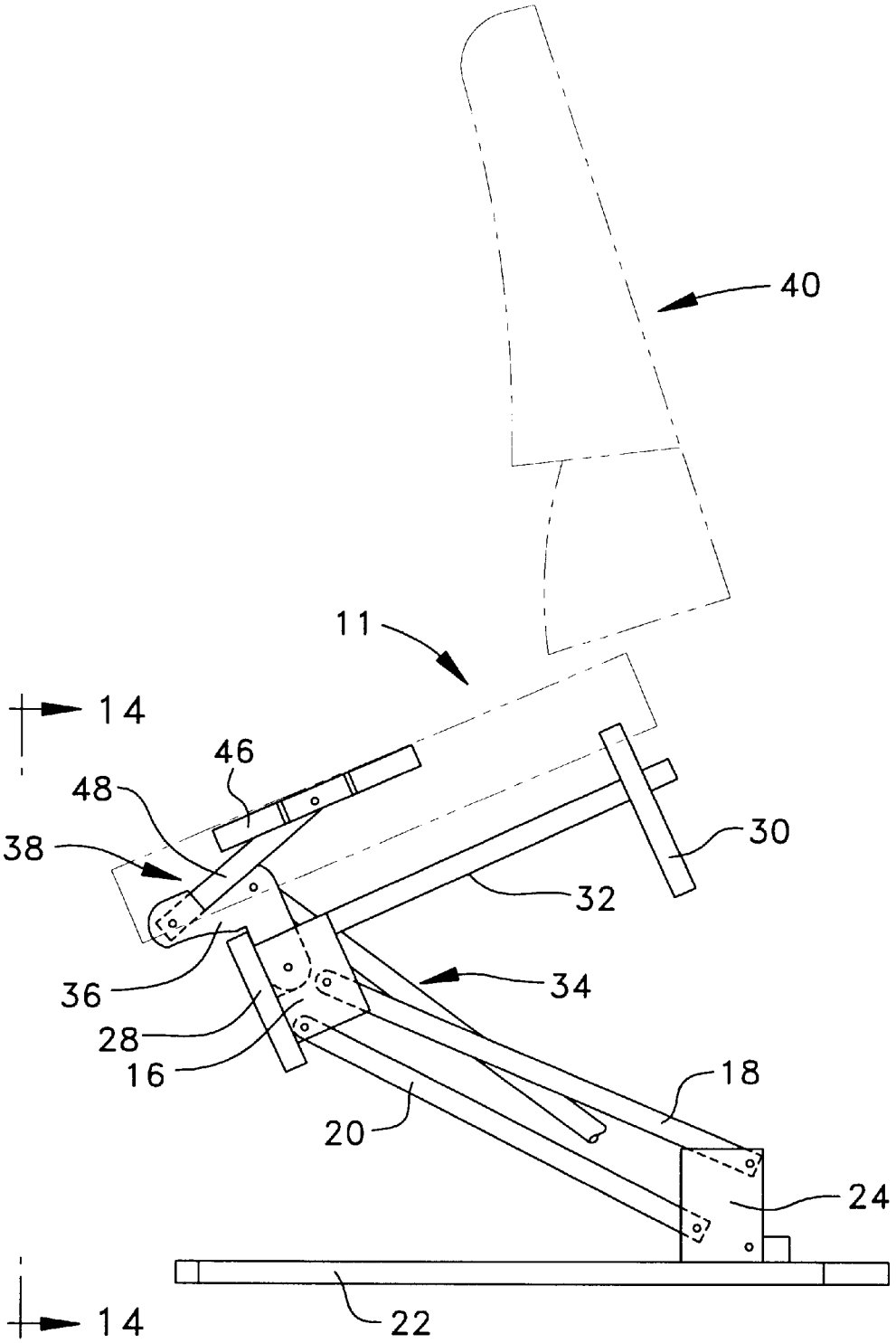
FIG. 10 is an interior side view similar to and taken at the same position as FIG. 6 through 9 but with the lift chair fully raised.
Figure 18:
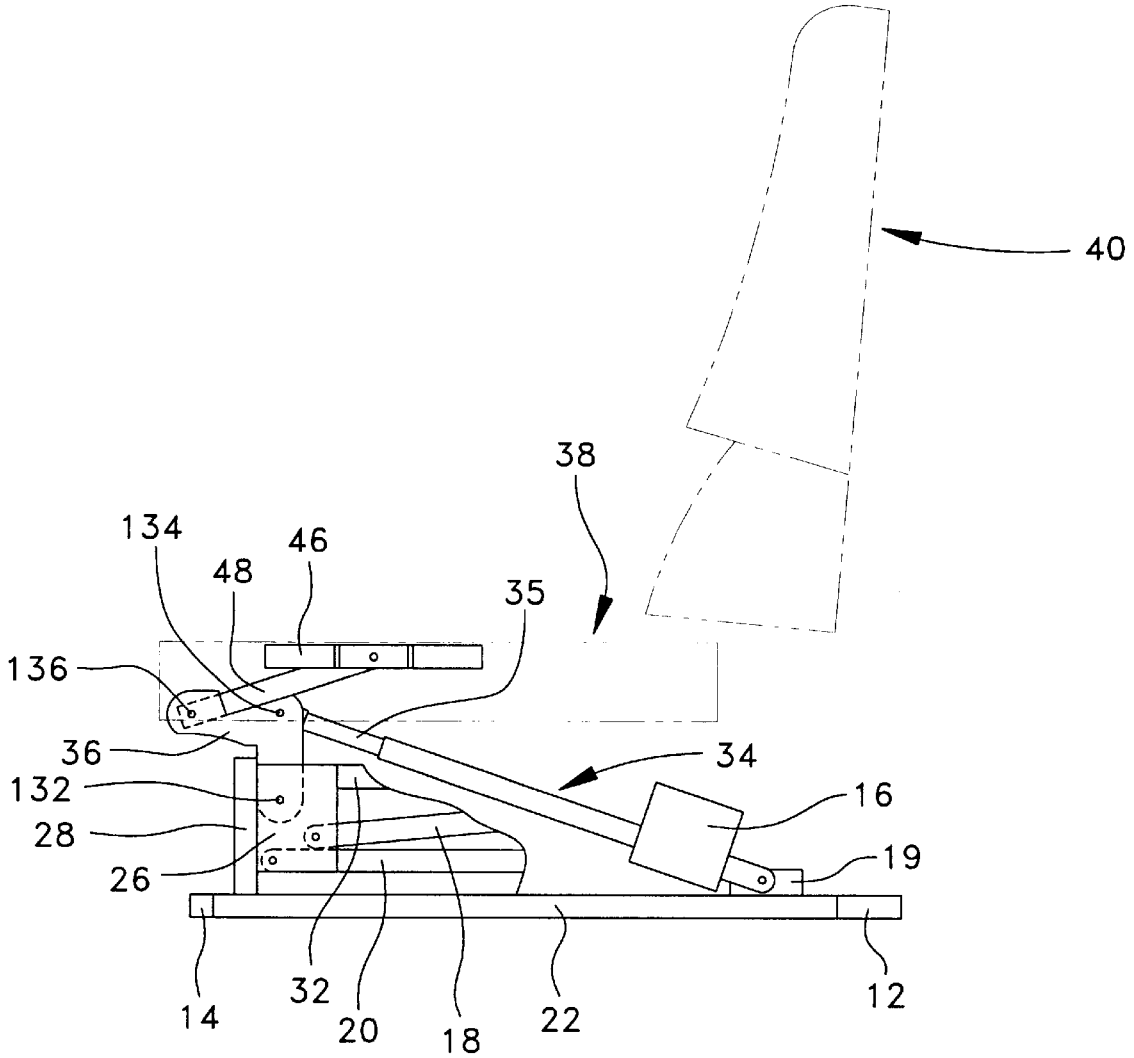
FIG. 18 is a side view of a portion of the lift mechanism of the lift chair of the invention in which certain interior portions of the chair had been removed in order to better show certain portions of the lift mechanism, in which other portions have been broken away a in which the chair seat and chair back have been illustrated in phantom, with the lift chair depicted in the neutral or conventional seating position corresponding to FIG. 6 and FIG. 11.
Figure 19:
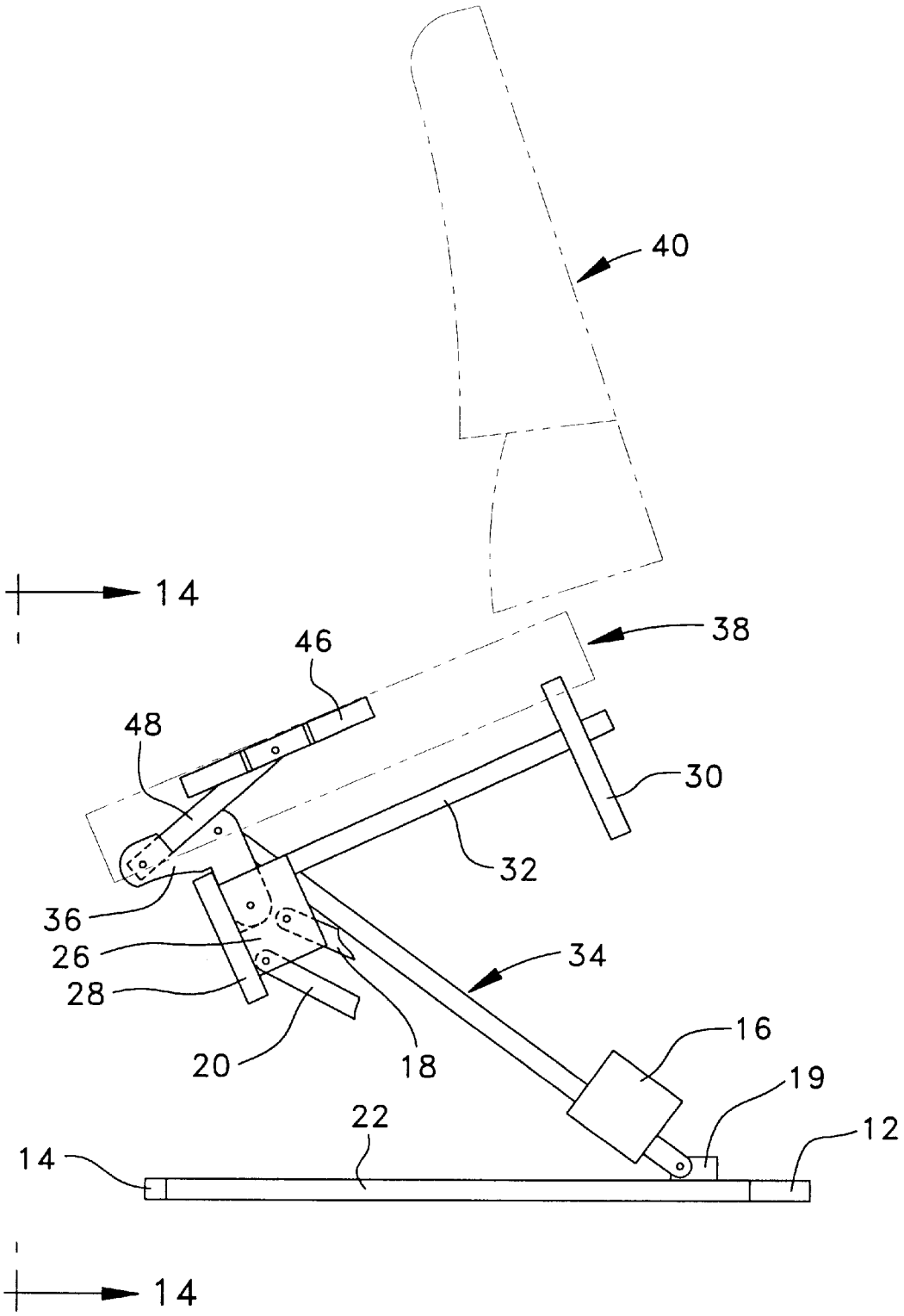
FIG. 19 is a partially broken side elevation showing the same structure as FIG. 18 but with the lift chair in the fully lifted position shown in FIG. 10 and depicted schematically in FIG. 5.
Figure 20:
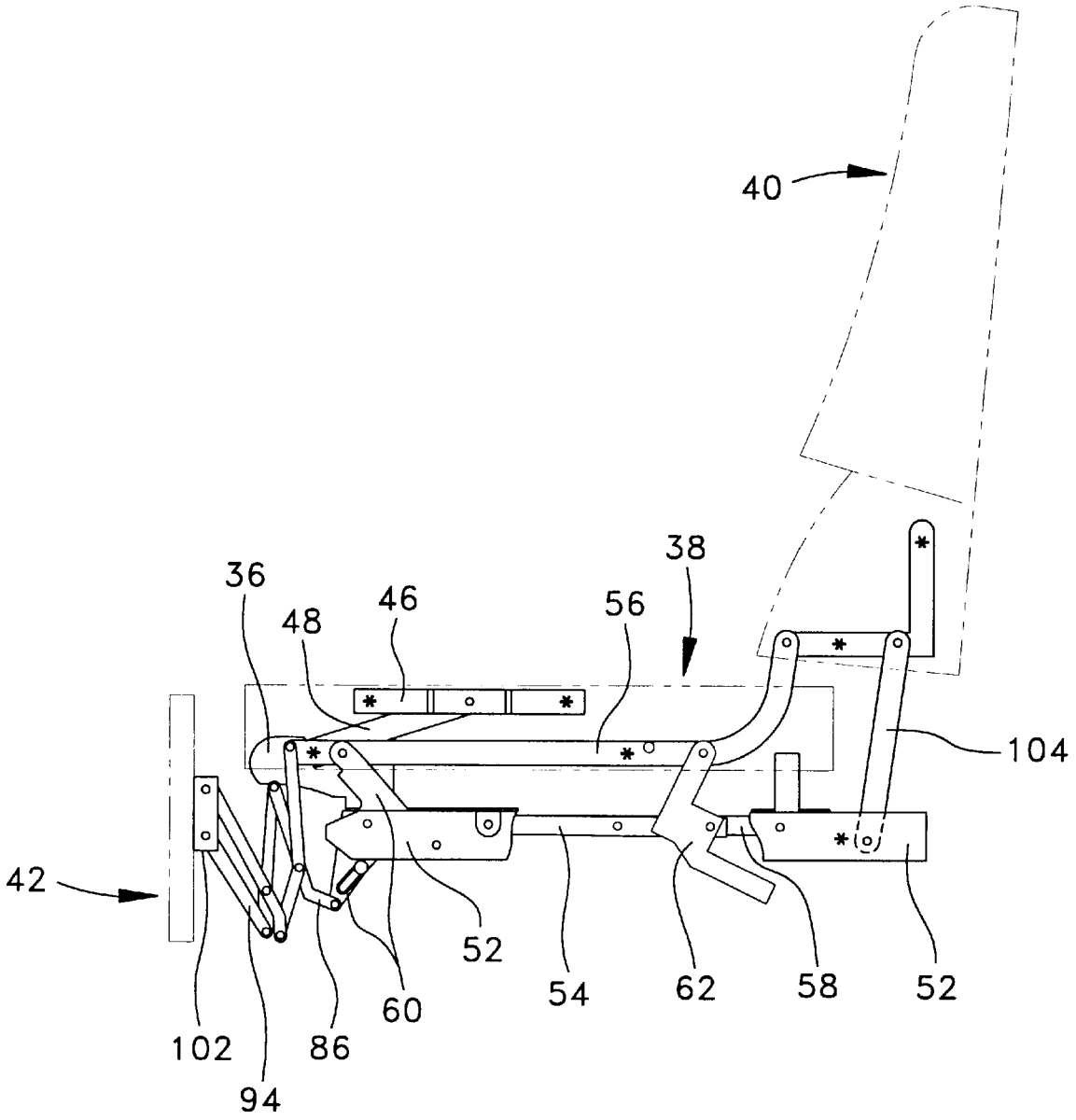
FIG. 20 is a side view of the lift chair in which the drawing is analogous to FIG. 11 but in which portions of the lift chair mechanism have been broken away to reveal internal structural details in a manner similar to that illustrated in FIG. 12 and other portions of the structure have been omitted.

When the chair is raised from the seated starting position illustrated generally in FIGS. 6, 11 and 18 to the occupant arising or tilting position illustrated generally in FIGS. 10 and 19, bell crank 36 is in abutting contact with front elevator frame cross-member 28. Continued advancement of motor shaft extension 34 causes bell crank 36 to try to rotate; however, this rotation is restrained by abutting contact of bell crank 36 with front elevator frame cross-member 28. As motor shaft extension 34 continues to extend, upper and lower elevator arms 18 and 20 rotate about their points of pivotal connection with rear frame side plates 24, thereby permitting the lift mechanism and particularly the portion of the lift chair frame associated therewith to rise and no longer be supported by side frame base rails 22, as illustrated generally in FIG. 9. Continued extension of motor extension shaft 34 causes continued lifting of the lift chair seat, back and leg support portions 38, 40, 42 into the position illustrated in FIG. 10 at which an occupant may easily arise from the chair due to the downward slope, from back to front, of chair seat portion 38. During the lifting operation, all of the above-recited links and bars that are connected, directly or indirectly, to first longitudinal bar 52 are stationary and chair leg support portion 42 is in the retracted position as illustrated in FIG. 11. There is no relative movement between chair back portion 40 and chair seat portion 38 as the chair is lifted into position as illustrated in FIG. 10 for departure of the occupant therefrom.

FIGS. 1 through 5 illustrate in schematic form a portion of the lift chair recline and lift linkage mechanism, specifically the portion which facilitates lifting of the chair while the chair is in the occupant seated position.

Figure 3:
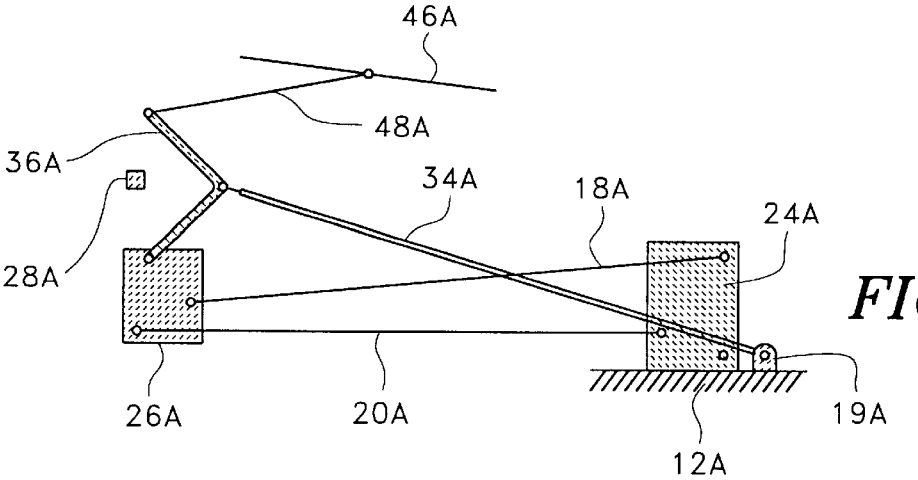
FIG. 3 is a schematic view similar to FIGS. 1 and 2 but with the lift chair being fully reclined.

Referring initially to FIG. 3, the lift chair is depicted schematically in the reclined position. As illustrated in FIG. 3, the motor extension shaft schematically depicted as 34A is essentially fully retracted. As a result, the bell crank, depicted schematically as 36A, is in position well removed from contact with front elevator frame cross-member schematically depicted as 28A.

Rear frame side plate depicted schematically as 24A defines one bar of a four-bar linkage. Front frame side plate depicted schematically as 26A defines a second bar of the four-bar linkage.

Pivotal mounting of the motor is depicted schematically as l9A with the motor mount being fixed together with schematically depicted rear frame side plate 24A to schematically depicted rear frame base rail 12A. A longitudinal seat support linkage bar schematically depicted as 48A connects one end of bell crank 36A, via a pivotal connection which has not been numbered in the drawings, to a schematically depicted chair seat support bracket shown as 46A, via another pivotal connection.

As the occupant actuates the hand control to extend the motor extension shaft 34A, the lift chair back assumes a more upright position and the leg horizontal support member is retracted. There is only very slight movement of the seat portion of the lift chair; this is indicated by chair seat support bracket schematically depicted as 46A in FIG. 2 being essentially in the same position as that illustrated in FIG. 3. Due to extension of motor extension shaft 34A to the position illustrated in FIG. 2 from the position illustrated in FIG. 3, bell crank 36A has rotated somewhat but has not yet contacted front elevator frame cross-member 28A, as clearly shown in FIG. 2. Consequently, the four-bar linkage defined by front and rear frame side plates 26A, 24A and elevator arms 18A, 20A has not actuated.

Figure 1:
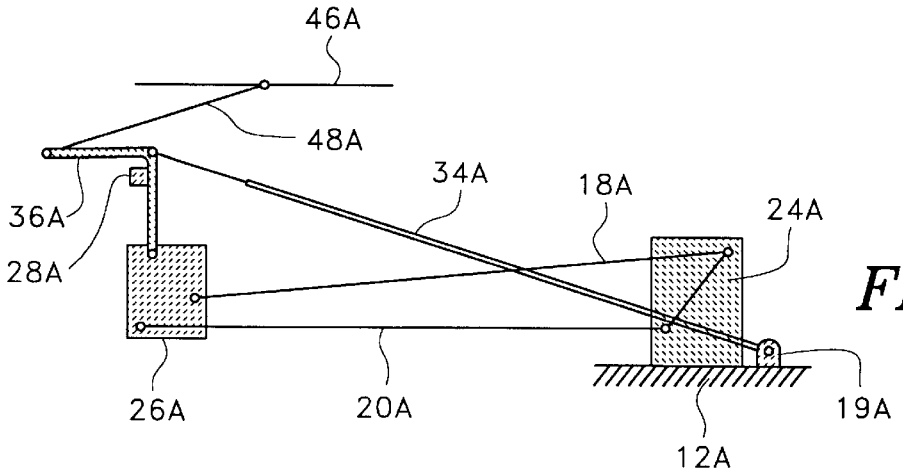
FIG. 1 is a side view schematically depicting a bell crank and a four-bar linkage manifesting aspects of the invention oriented in the position corresponding to the lift chair being in a conventional eating disposition.
Figure 2:
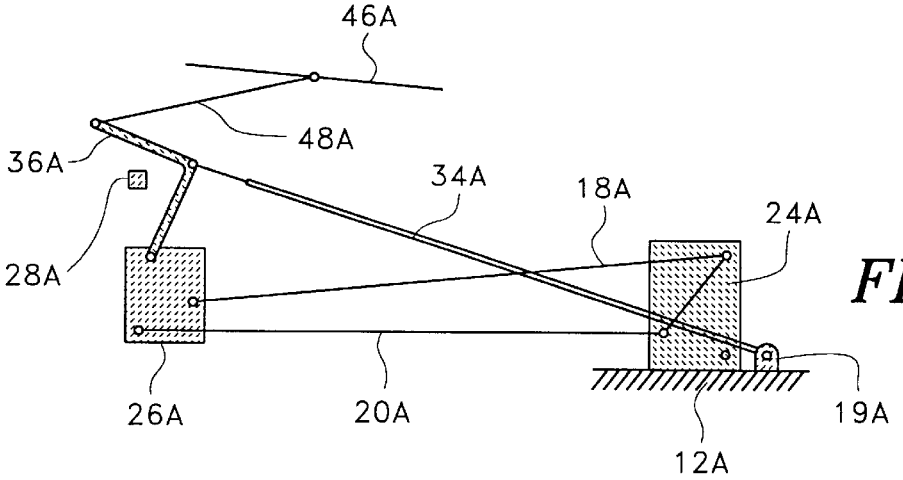
FIG. 2 is a schematic view similar to FIG. 1 corresponding to the lift chair being in a somewhat reclined position.

Upon continued extension of the motor extension shaft illustrated schematically as 34A, bell crank 36A continues to rotate until bell crank 36A contacts front elevator frame cross-member 28A and assumes the position illustrated in FIG. 1. At this position, chair seat support bracket 46A connecting to bell crank 36A by longitudinal seat support linkage bar 48A has moved slightly into an essentially horizontal position to support a chair occupant in a conventional seated position. In practice, chair seat support bracket 46A is preferably affixed to chair seat portion 38A in a manner to provide a slight rearward tilt to the chair seat portion when the chair is in this upright "seated" position, since chair occupants find such a slight rearward tilt of the chair seat portion and a corresponding slight rearward tilt of the chair back portion to be most comfortable for conventional sitting.

Figure 4:
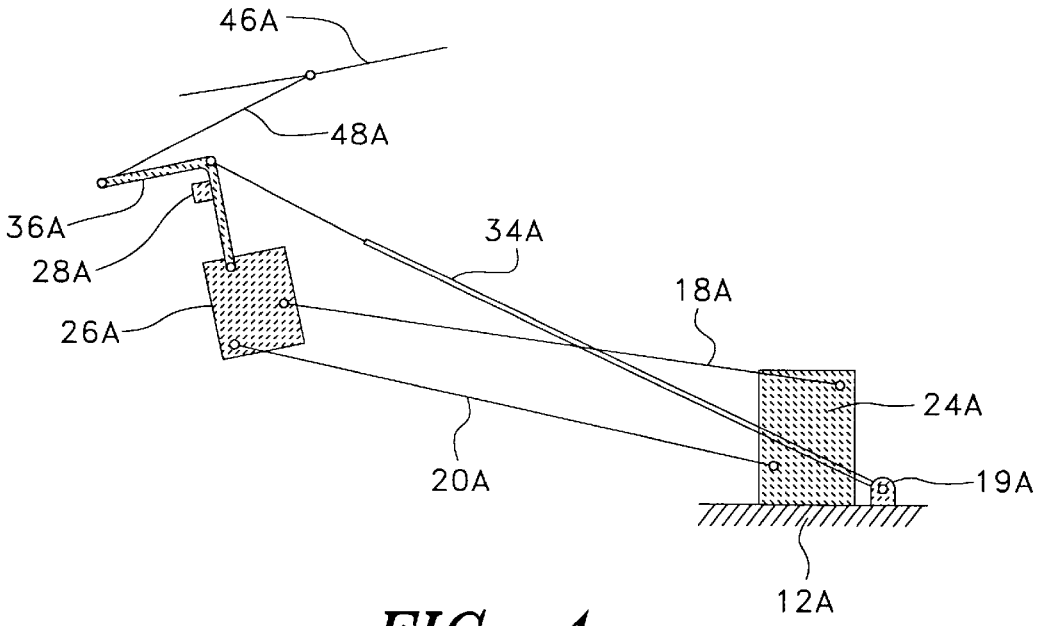
FIG. 4 a schematic view similar to FIGS. 1 through 3 but with the lift chair partly raised.

As motor extension shaft 34A continues to extend due to operation of the motor, the apparatus assumes a configuration illustrated schematically in FIG. 4. At this position, due to the extension of motor shaft 34A relative to motor pivotal mounting point 19A, the motor through motor extension shaft 34A has lifted bell crank 36A, longitudinal seat support linkage bar 48A, chair seat support bracket 46A, front elevator frame cross-member 28A, front frame side plate 26A and elevator arms 18A and 20A into the position illustrated in FIG. 4. In this position, elevator arms 18A, 20A and front and rear side plates 26A, 24A define the four-bar linkage. Pivotal motor mount 19A facilitates upward rotation of motor extension shaft 34A as the shaft extends without creating excessive bending stresses on motor extension shaft 34A.

Figure 5:
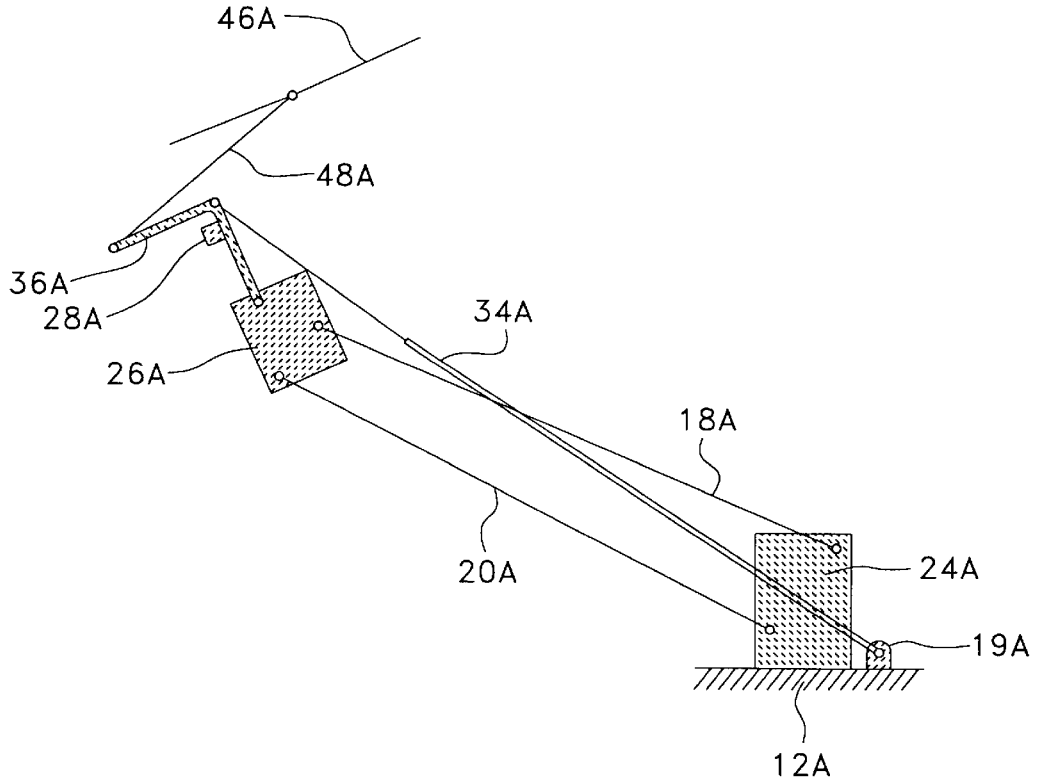
FIG. 5 schematic view similar to FIGS. 1 through 4 but with the lift chair fully raised in position to assist the occupant in arising therefrom.

As motor extension shaft 34A continues to rotate and assume a position of maximum extension as illustrated generally in FIG. 5, action of the four-bar linkage defined by elevator arms 18A, 20A and front and rear side plates 26A, 24A effectively rotates side plate 26A from the position illustrated in FIG. 4 to the position illustrated in FIG. 5. This, in turn, effectively rotates bell crank 36A together with front elevator frame cross-member 28A, longitudinal seat support linkage bar 48A and chair seat support bracket 46A, since bell crank 36A is fixed in position relative to front frame side plate 26A by virtue of being forced against front elevator frame cross-member 28A by the continued extension of motor extension shaft 34A.

Since front elevator frame cross-member 28A is fixedly connected to front frame side plate 26A by welding, bell crank 36A cannot rotate any further respecting front frame side plate 26A; this position is illustrated in FIGS. 3, 4 and 5. Hence, action of the four-bar linkage and specifically continued elevation of the movable bars (defined by elevator bars 18A and 20A and front side plate 26A) of the four-bar linkage results in the lift chair being tilted forward to assist the occupant in arising therefrom with the chair being in the position depicted in FIG. 10, where parts illustrated schematically in FIGS. 1 through 5 are shown in detail.

Figure 32:
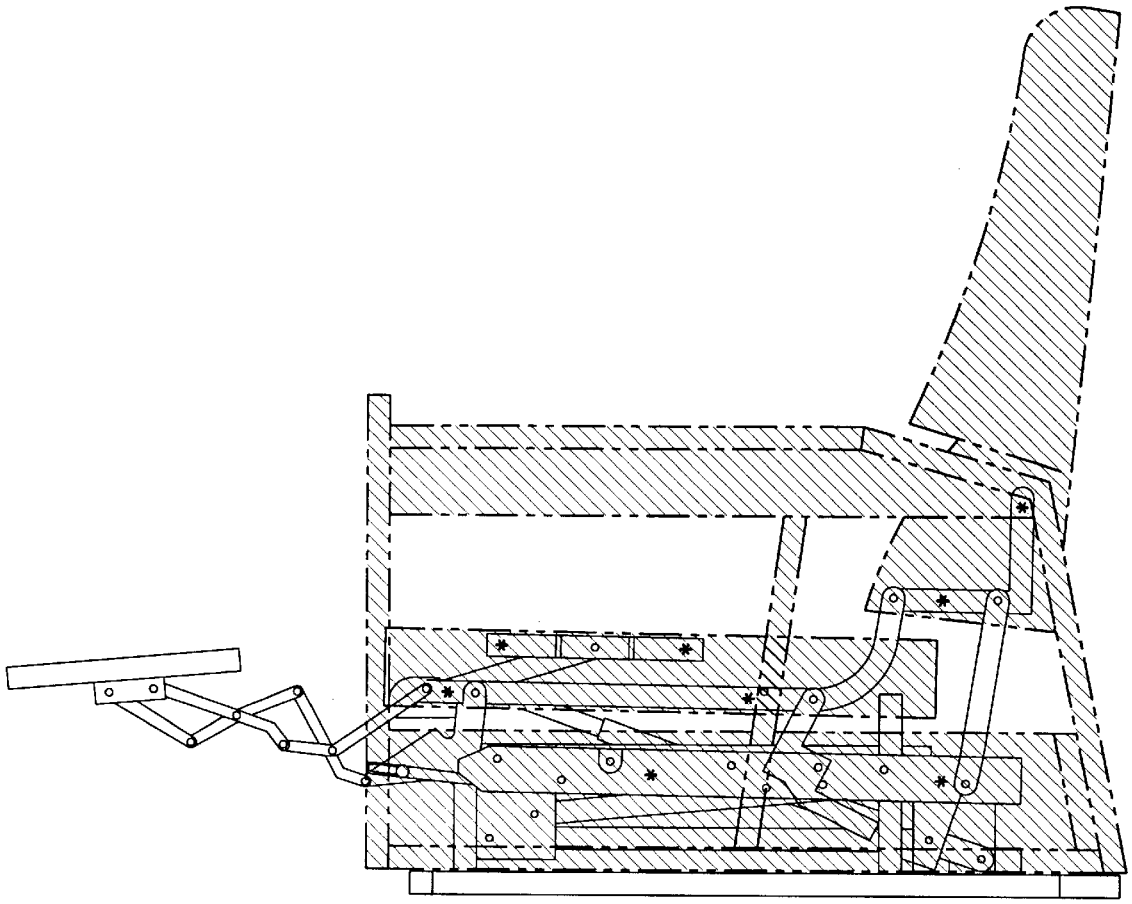
FIG. 32 is a side elevation of a lift chair embodying the invention with the lift mechanism illustrated in solid lines and the wood frame and upholstered portions of the chair illustrated schematically in dotted lines.

During the lifting, the preferably wood or plastic side frame pieces which are provided to effectuate the connection between the outer extremities of front and rear elevator frame cross-members 28, 30 and first longitudinal bar 52, to which the links and bars described above are directly or indirectly connected, rise along with the front and rear elevator frame cross-members 28, 30 to which the wood or plastic side members, illustrated in FIG. 32, carrying first longitudinal bars 52 are affixed.

Respecting FIG. 32 illustrating the chair in silhouette, the entire upholstered portion of the chair, namely the chair seat, the chair back, the chair arms, etc. which are illustrated in cross-hatching to denote the upholstering and wood framing of the lift chair of the invention, are supported on the outer extremities of the front and rear elevator frame cross-members 28, 30 and built up from there, specifically from side member 110 shown in FIG. 13.

Both front and rear elevator frame cross-members 28, 30, illustrated in FIGS. 13 and 24 are preferably of one-piece construction. With such one-piece construction, with the front and rear elevator frame cross-members being fabricated from hollow, preferably rectangular and most preferably square cross-sectional preferably steel tubing, at the curved shapes that are formed in the course of fabricating front and elevator frame cross-members 28, 30, the radii created result in increased strength at these curved portions due to the creation of web-like or flange-like concave or convex structure in the upwardly and downwardly facing surfaces of these tubular front and rear elevator frame cross-members 28, 30. In the drawings, specifically FIG. 14, upper curved portions of front elevator frame cross-member 28 are denoted 112, lower curved portions of front elevator frame cross-member 28 are denoted 114, upper curved portions of rear elevator frame cross-member 30 are denoted 116, and lower curved portions of rear elevator frame cross-member 30 are denoted 118.

With the tubular construction of front and rear elevator frame cross-members 28, 30, the seat portion 38 of the lift chair can be bolted directly thereto. Additionally, with the configuration of front and rear elevator frame cross-members 28, 30 and particularly the configuration of rear elevator frame cross-member 30, in the event of a failure of the preferably welded connection between rear elevator frame cross-member 30 and elevator frame side member 32, the bridging effect provided by the configuration of rear elevator frame cross-member 30 prevents chair seat portion 38 from dropping excessively. Specifically, in the event of a failure of one or both of such weld connections, the transverse portion of rear elevator frame cross-member 30, designated 120 in the drawings, specifically the lower surface thereof, would contact elevator frame side member 32 where the weld connection had broken thereby insuring that the chair seat portion 38 and any occupant therein would experience only a small drop, perhaps about two inches upon the failure of any such weld. Once transverse central portion 120 of rear elevator frame cross-member 30 contacts elevator frame side member 32 by falling thereonto, there will be no further drop experienced by a chair occupant seated on chair seat portion 38.

A further advantage resulting from the one-piece construction of front and rear elevator frame cross-members 28, 30 and the welding affixment thereof, in the case of front elevator frame cross-member 28, to vertical edges of front frame side plates 26 and, in the case of rear elevator frame cross-member 30, to the outwardly facing lateral surfaces of elevator frame side members 32, is the increased rigidity of the resulting chair elevator frame 25. Most desirably, the weld connections between front frame side plates 26 and front elevator frame cross-member 28 extend substantially the vertical length of the vertically extending edges of front frame side plates 26 to provide an extremely high strength chair elevator frame 25.

The one-piece construction of front and rear elevator frame cross-members 28, 30 is less expensive than using multiple pieces for these functions. The resulting one-piece construction provides greater resistance to twisting, thereby reducing side loadings on the pins and bushings providing the pivotal connections in front and rear frame side plates 26, 24 respectively.

Figure 37:
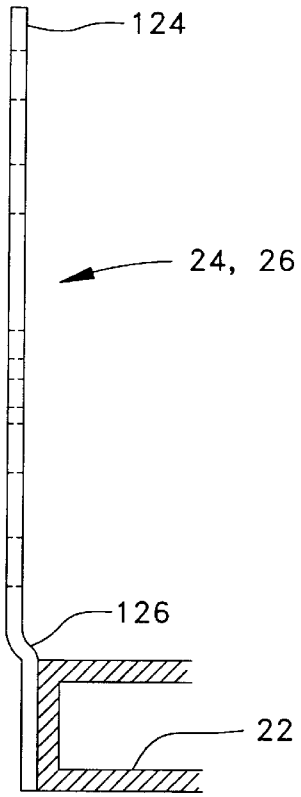
FIG. 37 is a front to side view of a universal side plate for a lift chair frame manifesting aspects of the invention.
Figure 36:
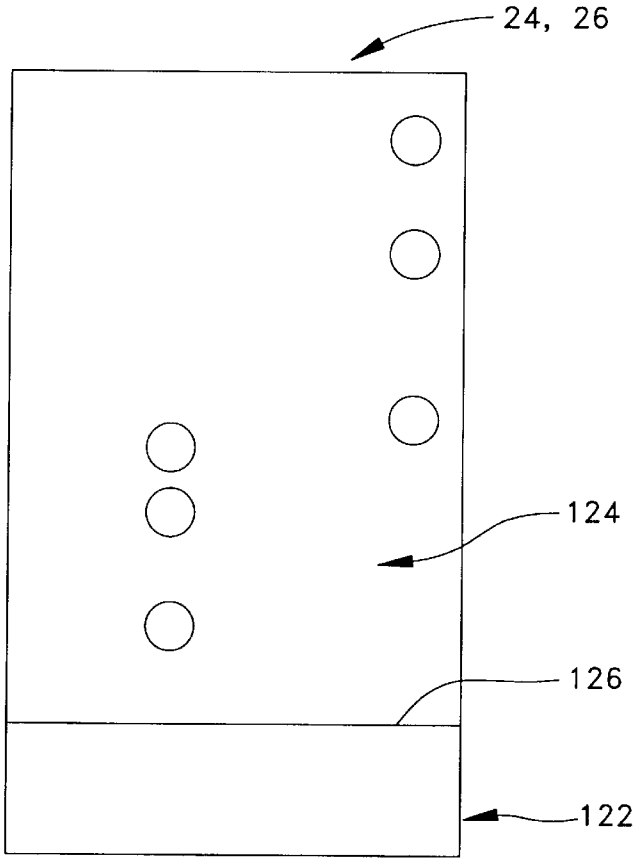
FIG. 36 is a front view of a universal side plate for a lift chair frame an manifesting aspects of the invention.

As illustrated in FIGS. 36 and 37, front frame side plates 26 and rear frame side plates 24 are universal side plates in that they are interchangeable one with another before being installed as a part of the lift chair frame assembly. These universal side plates are drilled appropriately to be positioned either as indicated by numerals 26 or 24 in the drawings.

Each side plate 24, 26 includes a base portion 122 and an upstanding portion 124 connected to base portion 122 via an offset 126. Side plates 24, 26 are positioned relative to side frame base rails 22 and elevator frame side members 32, to which side plate 24, 26 respectively are welded, in the manner illustrated in FIG. 35 where a side frame base rail 22 has been illustrated broken away so as to indicate the side of base plate 24, 26 which would be in complemental, facing contact and secured by welding to either a side frame base rail 22 or an elevator frame side member, depending on whether the side plate were used as a front frame side plate 26 or as a rear frame side plate 24.

The offset provided as 21, 26 preferably amounts to about the thickness of the side plate which may preferably be in the neighborhood of ⅛" to 3/16". Offset 126 means that upstanding portions 124 of pairs of front and rear frame side plates 26, 24 are preferably separated one from another slightly more than the width of upper and lower elevator arms 18, 20 thereby providing some lead-in for elevator arms 18, 20, facilitating smooth operation of the lift chair apparatus and providing greater comfort and assurance of security to the chair occupant.

As further illustrated in FIGS. 36 and 37, the universal side plate 24, 26 is drilled with apertures to facilitate use of the universal side plate as either a front frame side plate 26 or a rear frame side plate 24. Additionally, the plates are drilled to facilitate positioning the upper elevator arm 18 at selected different positions in front frame side plate 26.

Lift chair seat portion 38 is secured to front and rear elevator frame cross-members 28, 30 preferably using screws that are driven through the lower, transversely extending extremity portions of front and rear elevator frame cross-members 28, 30 respectively. In these areas where chair seat portion 38 is secured to elevator frame cross-members 28, 30 respectively, screws are preferably driven upwardly through these cross members into the preferably wood portion of the lift chair frame. Holes are preferably provided in the hollow transversely extending tubular extremities of front and rear elevator frame cross-members with holes in the lower portions of these cross-members 28, 30 being larger than holes in the upper portions so that screws can be driven with their heads resting against the interior of the upper portion of the tubular transversely extending extremity of the elevator frame cross-members 28, 30 so that the upper portion of the tubular transverse extremity of the elevator frame cross-member 28, 30 effectively acts as a washer as the screw is driven into the wood portion of the chair base. This construction prevents any tendency of the tubular transversely extending extremities of front and rear elevator frame cross-members 28, 30 to collapse, which might otherwise result if such screws contacted the lower walls of the tubular transversely extremities of the elevator frame cross-members 28, 30 and extended through the hollow interiors of the tubular transversely extending elevator frame cross-members 28, 30 into the wood portion of the chair base.

The angle of pitch of seat portion 38 and back portion 40 at the position of maximum of the lift chair illustrated generally in FIG. 10 can be adjusted by adjusting the position of upper elevator arm 18 in front frame side plates 26. Specifically, upper elevator arm 18 is retained in position between front frame side plates 26 by a clevis/rhue pin combination to facilitate such adjustment. Two sets of holes are provided in front frame side plates 26. Positioning upper elevator arm 18 for pivotal connection respecting the lower of the two sets of holes produces a different angle of tilt at the extremity of chair lift than that provided when positioning upper elevator arm 18 in the upper more of the two sets of holes in front frame side plate 26.

Rear frame base rail 12 shown in FIG. 24 and other drawing figures has extremities that are curved in the longitudinal direction with these curved extremities being designated 128. Curved extremity portions 128 permit a wide, large and long footprint for lift chair 10 resulting in high stability for lift chair 10. These curved extremities further permit rear frame base rail 12 to function as a cross-member, cross-bracing the entire lift chair mechanism. Rear frame base rail 12, front frame base rail 14, side frame base rails 22 and frame support member 15 are all preferably rectangular tubular steel members having the same cross-sectional dimensions.

Where welds are not used, 5/16" hexhead self-tapping fasteners are used throughout.

An important feature facilitated by the lift chair mechanism of the invention is the early opening or actuation of the leg support 42 which provides what many refer to as the "perfect television watching position". At this position, the movable leg support portion 42 supports the chair occupant's lower legs but the chair has not reclined so that the occupant's torso is upright, erect and in a position to watch television. This capability of the chair to achieve the "perfect television watching position" results from the combination of the geometry of the chair frame mechanism, including the scissors-type leg support portion extension mechanism 82 which moves chair movable leg support portion from the vertical position into the leg horizontal support position illustrated generally in FIG. 12.

Motor 16 is preferably a low voltage DC motor available from Daevert. This motor includes a transformer stepping down line current from 120 volts to somewhere in the neighborhood of 32 to 38 volts and a bridge to perform the rectifying function to provide the required direct current. Motor control is effectuated through relays which allow very low amperage current to go through the handpiece control. Current through the handpiece is preferably in the neighborhood of about 70 milliamps at the 38 volts required by the motor. A significant advantage from the low voltage and low current operation is to substantially increase the expected life of the switch in the handpiece because the low level current through the switch. Substantially no arcing is produced in the switch contact as a result of the use of the low current.

Motor rotation is converted to linear motion through a worm gear and pinion or rack combination. Preferably, the pinion or rack is metal and the worm gear is nylon. Use of these dissimilar materials, namely a steel or other metal pinion or rack and a nylon or other plastic worm gear, provides smooth, quiet operation of the motor extension shaft 34 resulting in the smooth operation of the chair providing a feeling of security for the chair occupant.

The exposed, movable portion of motor extension shaft 34 is preferably anodized to provide exceedingly low friction so that there is no binding as motor extension shaft 34 emerges from a preferably nylon bushing at an end of the outer tube.

Mounting of motor 16 to base frame motor mount plate 17 is by means of a clevis pin which permits rotation of motor 16 as required. Some rotation of motor 16 is needed since once bell crank 36 contacts front elevator frame cross-member 28 and upper and lower elevator arms 18 and 20 begin to rotate and lift seat and back portions 38, 40 of the lift chair, the point of connection of motor extension shaft 35 with bell crank 36 moves upwardly somewhat, thereby requiring that motor 16 be pivotally connected to base frame motor mount plate 17 in order to minimize resultant bending stress in motor extension shaft 34 and shaft extension portion 35.

Figure 26:
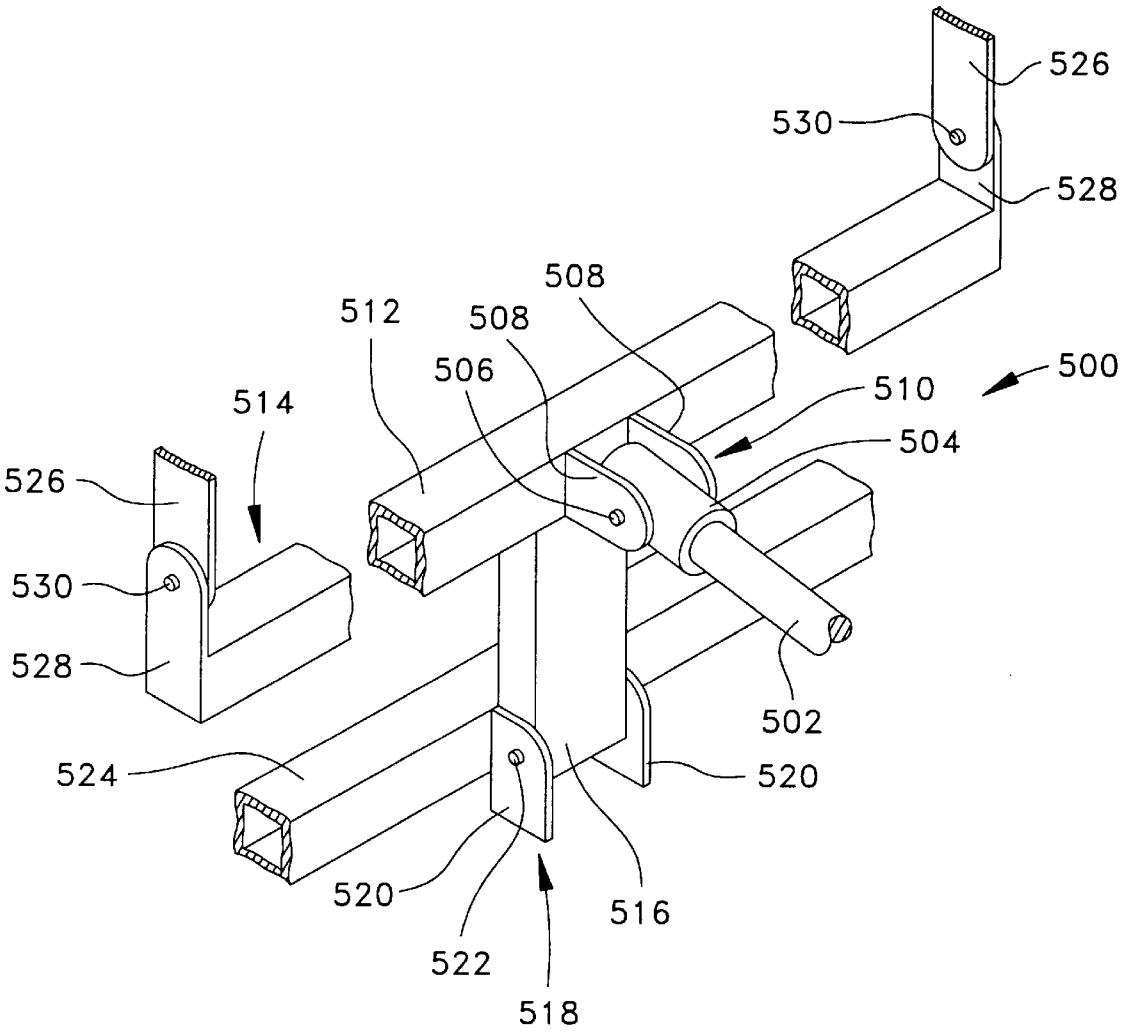
FIG. 26 PRIOR ART
FIG. 26 is a broken isometric view illustrating a portion of a prior art lift hair linkage mechanism.

One of the keys to produce the exceedingly smooth operation of the lift chair embodying the invention is the fixed, immovable connection of longitudinal seat support linkage bar 48 to cross-member 108 of T-bracket 106. Longitudinal seat support linkage bar 48 is preferably welded to cross-member 108. In the prior art construction, as illustrated in FIG. 26, pivoting constructions have been used. These pivoting constructions permit a degree of freedom, permitting rotation of seat portion support arms 526 relative to an associated cross-bar 512. Since these arms 526 directly support the chair seat portion in the prior art, uneven, rough motion of the chair seat portion results.

In the construction according to the invention, with welding fixing longitudinal seat support linkage bar 48 relative to cross-member 108, the only permissible motion for these parts is about an axis, defined by the pivotal connection provided by pin 136 in FIGS. 15 and 16, which is itself moving relative to the base of the entire chair frame assembly. Specifically, these members rotate about the axis, defined by pin 136 which is located at one of the vertices of the triangular bell crank, which vertex adjoins the hypotenuse of the triangular bell crank and is removed from the axis, defined by pin 134 in FIGS. 15 and 16, about which the bell crank is driven by the motor shaft extension and is further removed from the axis, defined by pin 132 in FIGS. 15 and 16, about which the bell crank rotates which is provided by the pivotal pin connection 132 of the bell crank and bracket 134 affixing the bell crank 36 to front elevator frame cross-member 28.

Where necessary, two motors may be used if the chair occupant is obese. In such case, two motors are supplied and offset transversely from the position of the motor shown in the drawings. In such case, front elevator frame cross-member would have two bell cranks 36.

Figure 27:
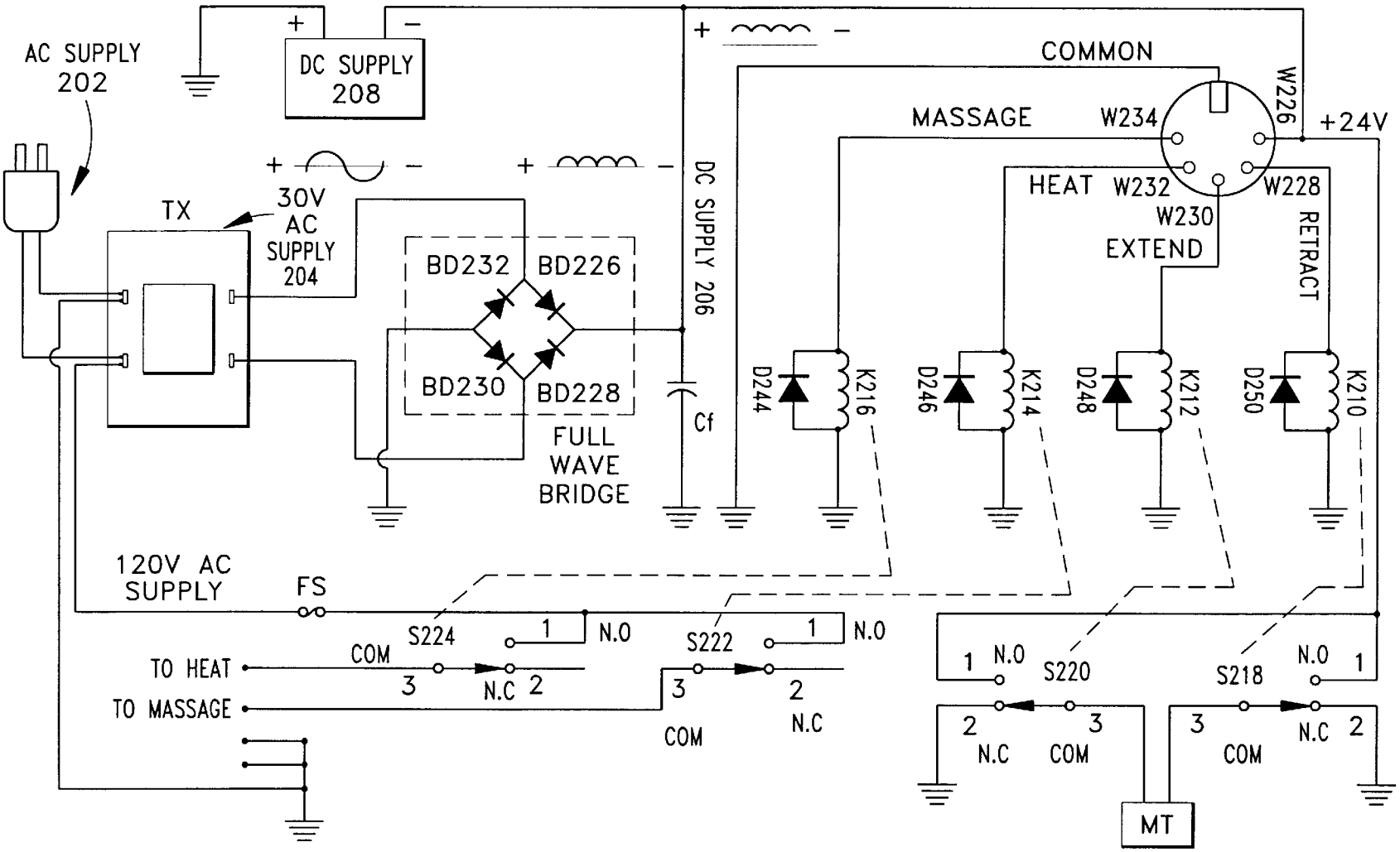
FIG. 27 is a schematic diagram of a therapeutic environment control system for a lift chair as illustrated in FIGS. 6 through 25.

A therapeutic environment control system for the lift chair is shown in FIG. 27 having AC supplies 202 and 204 respectively providing one hundred twenty volts and thirty volts. The thirty volt output of transformer TX produces a DC unidirectional pulsating output across full-wave bridge made up of diodes BD226–BD232 whose output voltage is smoothed by capacitor $C_f$ to provide a DC source 206. In parallel with the DC source is a temporary battery back-up DC source 208. The DC supply 206 is utilized as a voltage supply of extend/retract motor MT and of a low voltage control means of AC environment functions heat element 262 and massage elements 260 illustrated in FIGS. 33–35. A preferred heat element is heating means HP 84100 manufactured by Warmcraft. A preferred massage element is massage means VIB 803-P-38 also by Warmkraft. Variable massage may also be incorporated in the system of FIG. 31 such as Warmkraft Deluxe type VIB 803-P-38, enabling individual activation of five vibrating sections.

Unlike most manufacturers which incorporate AC signals into the control means, here the low voltage DC is employed to advantage. Through the isolated low voltage DC control of the AC line voltage accessories heat and massage through relays K210–K216, user safety is provided relative to the potentially lethal shock hazards present at the AC line 202. Although AC supply 202 includes overcurrent sensing device FS, preferably 1.5 ampere 120VAC such as Digikey picofuse F827-ND, AC current values below the fuse limit are nevertheless dangerous to users should circuit fault occur. The DC hand controls of the present invention are electrically isolated from the AC signal. For example, FIG. 29 shows the utilization of relays to achieve isolation of the low voltage DC actuation of the magnetic coil relay armatures K210–K216 to control higher voltage across remotely located relay switches. DC supply of the control means shown in FIG. 28 offers the additional advantage of extending the mechanical life of switch contacts S218–S224.

Referring again to FIG. 27, DC supply 206 is supplied by stepped down AC signal 202, tapped from line transformer TX having multiple primary capability, at a value of approximately thirty volts. Transformer TX is directly connected to a full wave bridge rectifier BD226–BD232 such as Mouser's 100 volt, 6 ampere 583-BR61 providing pulsating DC voltage to connected filter capacitor $C_f$.

DC supply 208 is a battery back up DC supply for use in the event of AC power failure. DC supply 208 of FIG. 27 provides emergency supply voltage to the therapeutic environment control system of FIG. 27 for limited operation of motor MT. The battery backup 208 enables a user to operate the extend/retract apparatus carriage if AC power is lost prior to retraction, or extension out of the seat for those users with limited mobility. Source 208 is also configurable in an alternative embodiment such that the battery supply utilized is rechargeable through additional recharging circuitry not shown.

Figure 28:
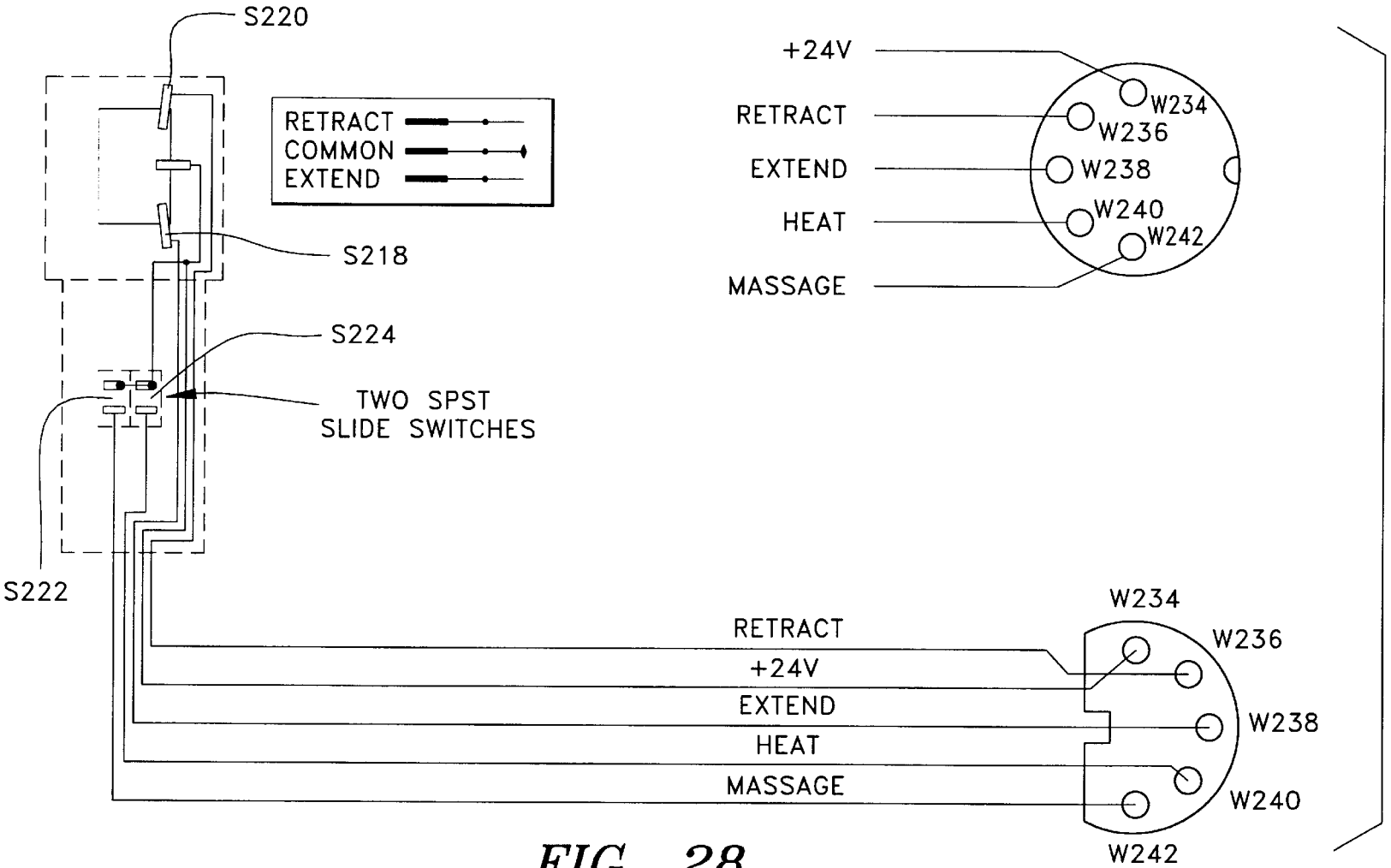
FIG. 28 is a schematic diagram of a hand control means for use with the control system of FIG. 27.
Figure 29:
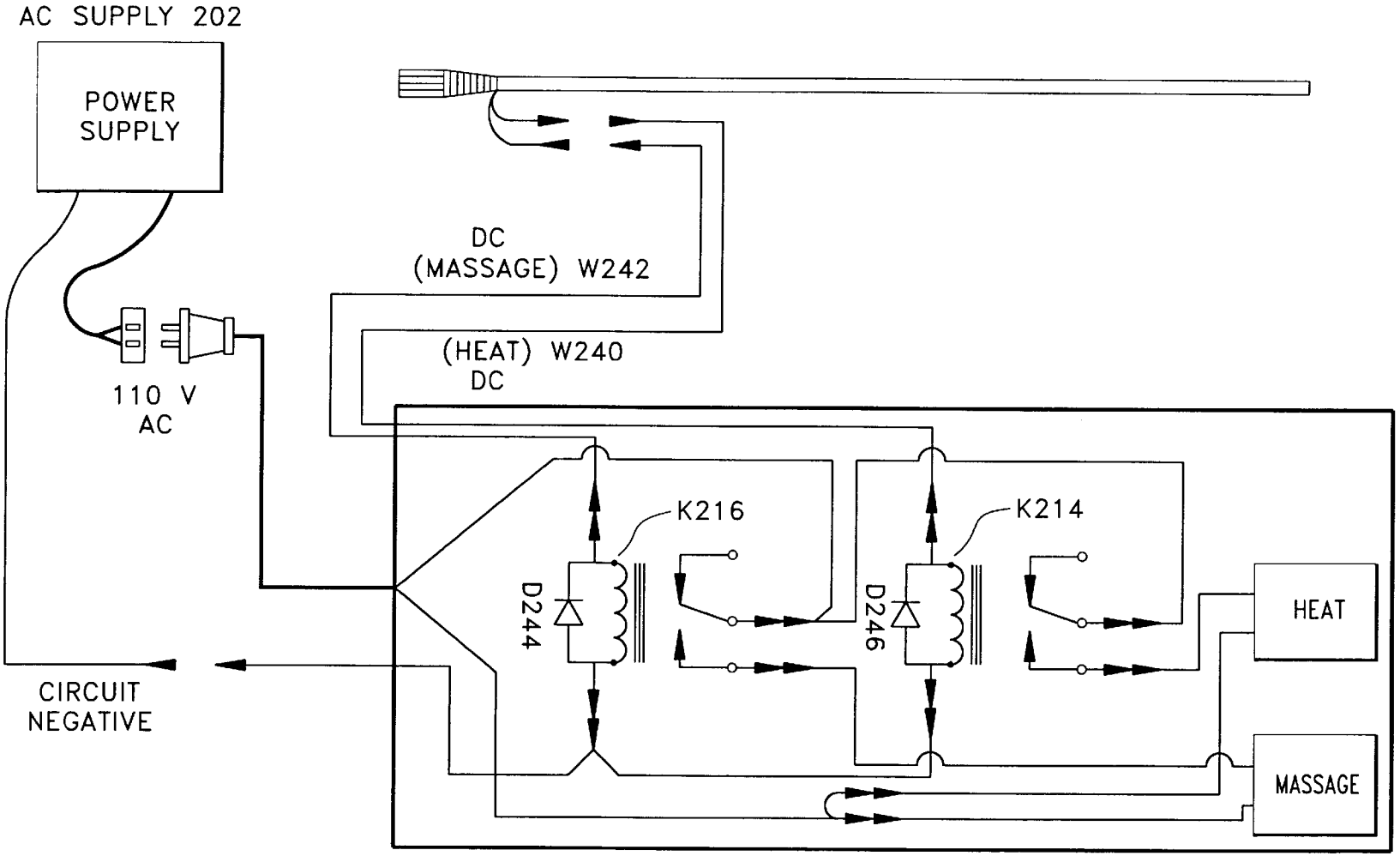
FIG. 29 is a schematic diagram of the low voltage DC signal processing nit for control of the AC line voltage utilized in the control system FIG. 27.

Specifically, referring again to FIG. 27, the filtered DC supply 206 or 208 is fed to hand control means FIG. 28 via wire W234 of the five wire conductor cord consisting of #18 AWG wire and connecting to the hand control means and wired to switches S218–S224. The hand control means of FIG. 28 consists of switch S224 for massage enabling and disabling, and switch S222 for heat enabling and disabling and switches S218/S220 for motor extension/retraction.

Switches S222 and S224 are SPST slide switches. When in the lowermost position of FIG. 28, no contact is made. When slid to a position in which the moving contact engages DC voltage on wire W234, electrical connection is completed to the corresponding heat or massage relay K214 or K216 in processing unit FIG. 29. The relays utilized are preferably of the type marketed by Schrack model TN313024 SPDT.

Switches S118/S220 are integrated in a single switch device. The switches S118/S220 are spring loaded such that when the rocker-type actuator is essentially centered as in FIG. 28, the switches are normally open, preventing electrical contact. When the rocker is pushed towards the extend contact, S220, the contact electrically connects to the switch common of S220 and provides a circuit path to wire W234 via wire W238 terminating in motor direction relay coil K212. The motor relays use the low current switch initialization of the hand control to effectively control the higher isolated 3 to 4 ampere DC current required to drive the motor MT. The diodes D244–D250 provide arc suppression means across the relay coils upon deactivation of the DC control means. Relays K210 and K212 of processing unit FIG. 29 are connected to AC supply 202 of FIG. 27 by relay armature contact terminals. Relays K210–K216 are normally disengaged from AC return signal path by spring loaded action of the relay armatures. When a DC signal is received from the hand control energizing a relay, the armature is pulled down by attractive force of the electromagnetic field. Overcoming the force of the spring the armature makes electrical contact with the AC return path of FIG. 29, thus activating the heat or massage functions illustrated in FIGS. 33–35. In this way, AC function heat and massage are controlled by the low voltage hand control.

Figure 33:
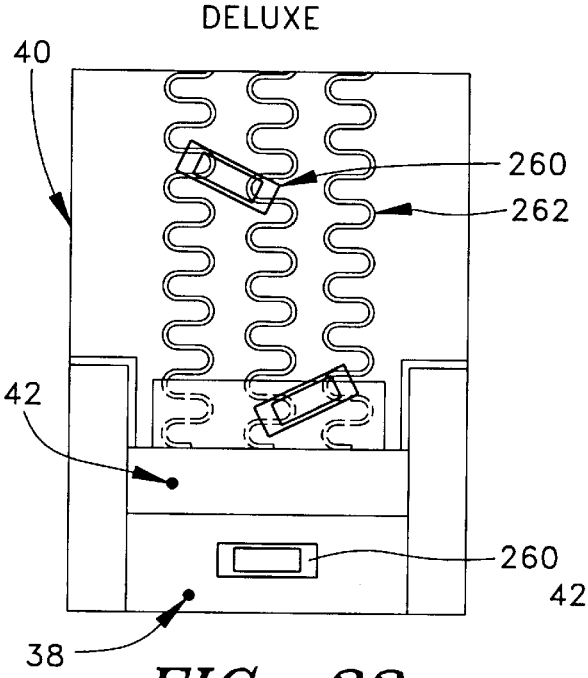
FIG. 33 is a front view illustration of heat and massage unit placement in a deluxe model therapeutic environment lift chair in accordance with FIGS. 6 through 25.
Figure 34:
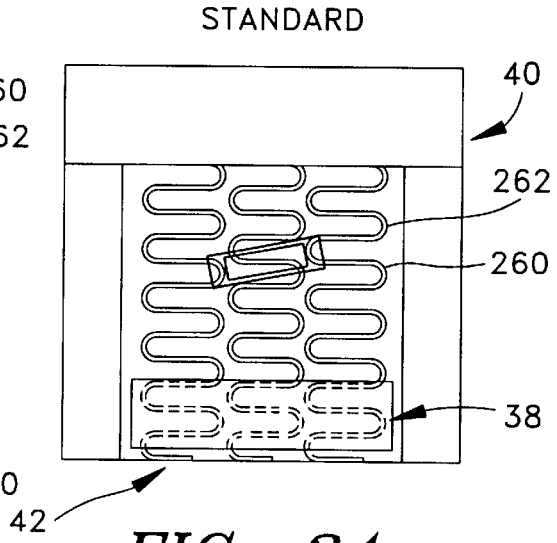
FIG. 34 is a bottom view illustration of the standard model therapeutic environment lift chair in accordance with FIGS. 6 through 25 an placement of heat and massage units therein.
Figure 35:
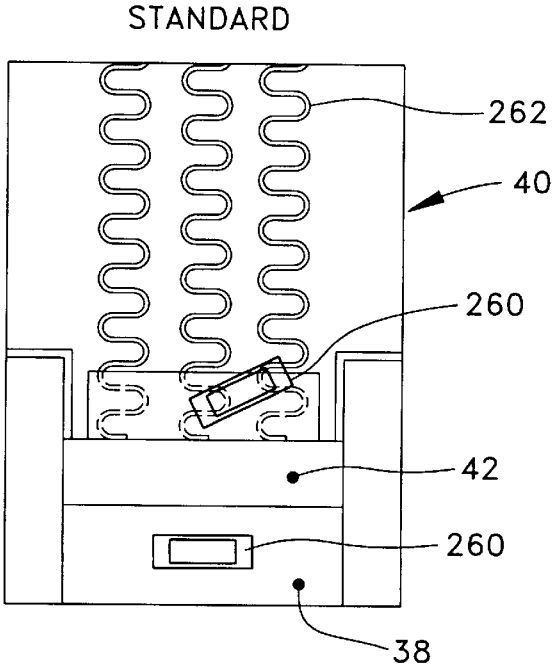
FIG. 35 is a front view illustration of the standard model therapeutic environment lift chair in accordance with FIGS. 6 through 25 and placement of the heat and massage units therein.

FIG. 33 is a front view of a deluxe model lift chair manifesting aspects of the invention. This deluxe model has structural side members 264, back member 40 with heating means 262, represented by the sinuous graphic representation and massage means 260 as demonstrated by the blocked graphic representation, seat member 42, and leg platform 38 along with massage means 260 in leg platform 38. The deluxe chair is distinguished from the standard model by additional massaging means 260 in back member 40. FIG. 34 is a bottom view of a standard model lift chair manifesting aspects of the invention illustrating seat member 42 and the massage and heating elements therein. FIG. 35 is a front view of a standard model chair manifesting aspects of the invention.

Relays K210–K212 of FIG. 27 control the extend/retract function of motor MT. The switch utilized in hand control FIG. 28 energizes the coil of the appropriate motor relay, causing the armature to complete a DC path to energize the motor. The extend and retract relays are attached to specific motor poles to effectuate the desired function, preferably using a motor of such type as the bi-directional standard low voltage Dewert models.

Figure 30:
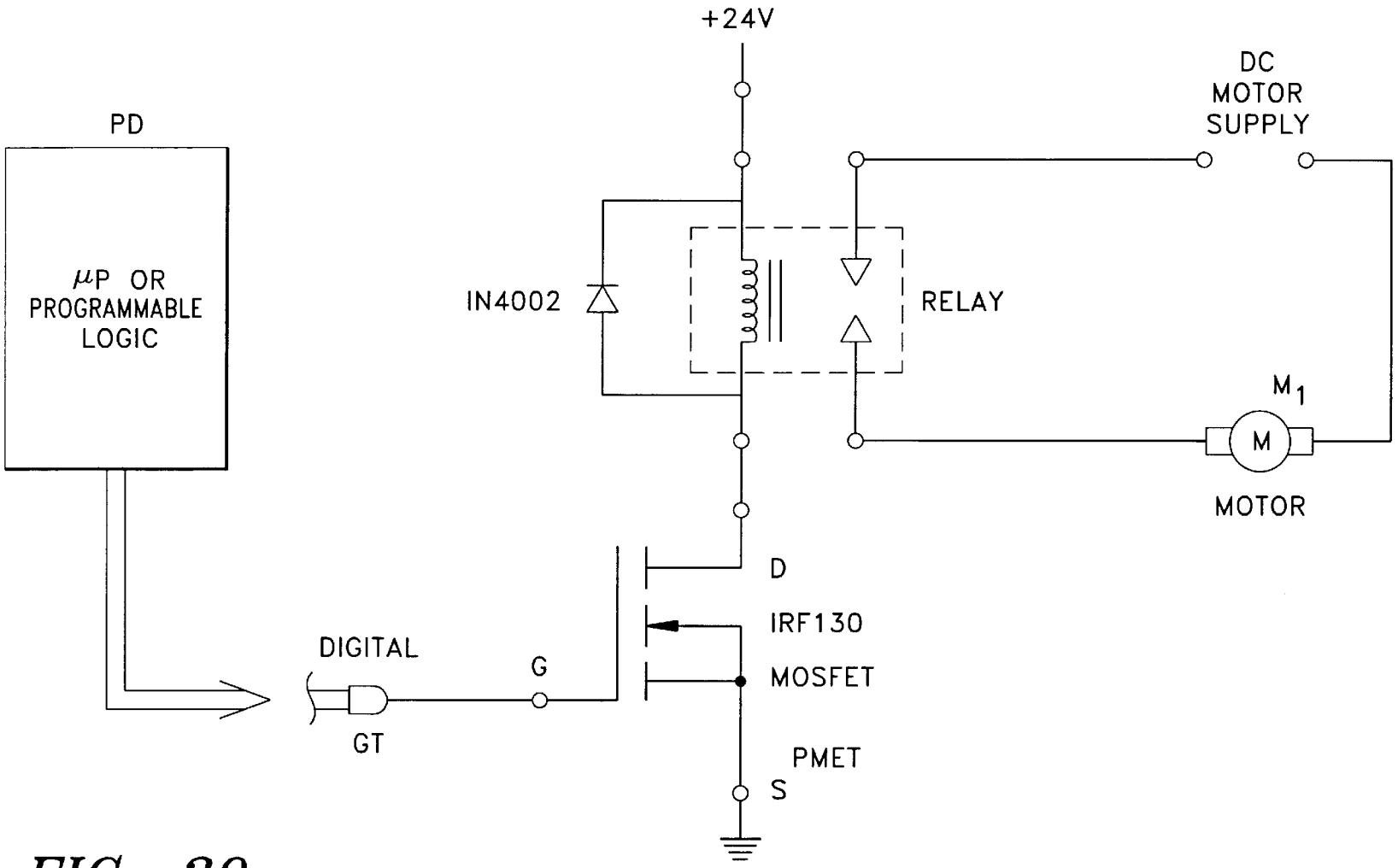
FIG. 30 is a schematic diagram of an alternative embodiment of AC supply 202 for variation of heat and massage function supply means.

FIG. 30 illustrates an alternative embodiment of the DC control processing of FIG. 27 for interface to a traditional 5 volt TTL digital system or lower voltage CMOS system. This embodiment provides means for an even lower control voltage through the use of logic means such as GT. The digital logic inputs are opened and closed by switching devices such as S218–S224 or switches with lower maximum voltage\current ratings. The alternative embodiment of FIG. 30 may also be interfaced with a microcontroller or similar programmable device PD as shown for sequential actuation of the therapeutic environment, thus providing an option for automated user therapy. The PD outputs the programmed switching sequence to the digital logic gates connected across its outputs for biasing of a power MOSFET PMET of standard type IRF130. Upon reception of a digital signal from the logic means GT on the PMET gate G, drain D to source S conduction occurs, allowing current to flow to the relay coil such as K210–K216, creating electromagnetic force required to actuate the armature to a close the switch to a motor conducting position. The motor can be reversed by an additional retract relay of identical design for reversing the motor bias. The motor as presently embodied is DC, however AC motor control may be accomplished in essentially the same manner.

Figure 31:
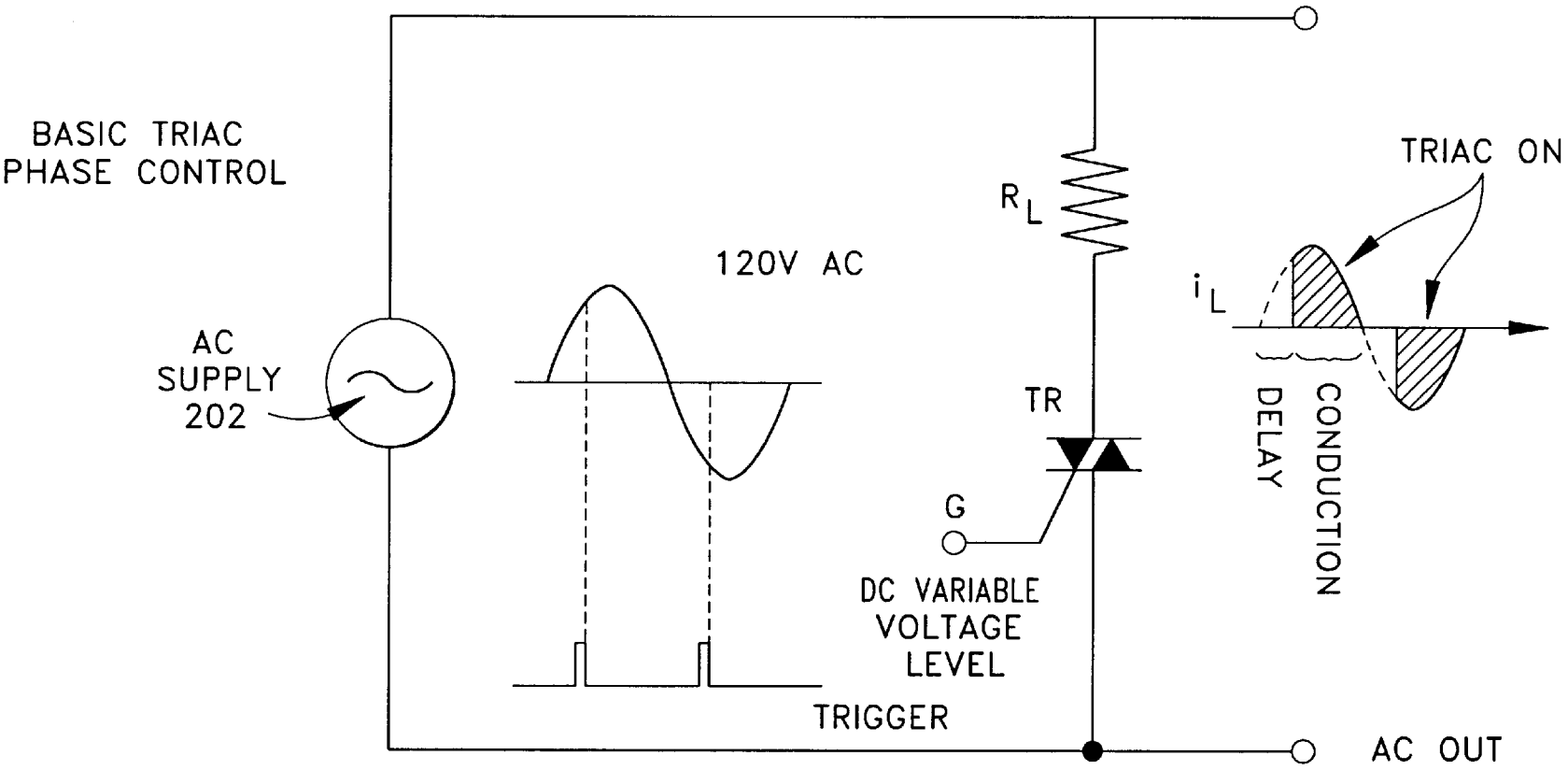
FIG. 31 is a schematic diagram of an alternative embodiment for DC control of control processing unit of FIG. 29.

FIG. 31 illustrates an alternative embodiment of AC supply 202 including a circuit for varying the duty cycle of AC supply 202 for the purposes of incorporating heat or massage level control means, which can similarly be operated from the hand control of FIG. 28. The embodiment includes a triac TR with a variable DC gate signal. The triac is triggered such that the AC power is supplied to the load for a controlled portion of each half-cycle. During each positive half-cycle of the AC, the triac TR is off for a certain interval determined by the DC control voltage at its gate. Then, it is triggered on and conducts current through during the remainder of the positive half-cycle and similar action occurs through the negative half-cycle. The duty cycle supplied to the heat and massage by means of switching relays K216 and K214, RL in FIG. 28 is in this way variably controlled by the voltage level across the triac gate. This alternative may similarly be utilized by the alternative embodiment of FIG. 30 for a variable rate automated therapy option.

The voltage variation of the triac gate can be accomplished from the hand control by a variable control in place of the switch of FIG. 28 by various known techniques.

What is claimed is:

1. A lift chair comprising:

a. a base frame;

b. an extendable/retractable chair occupant positioning apparatus, attached to the base frame;

c. a reversible D.C. motor for extension and retraction of said chair occupant positioning apparatus relative to the base frame;

d. a control means connected to said D.C. motor for actuation of said chair occupant positioning apparatus;

e. a power supply connected to the control means for motor control;

f. a chair occupant carriage supported by the base frame, the carriage comprising at least seat and back portions;

g. an elongated cross member extending laterally below said seat portion;

h. a bell crank having two fixedly connected transverse legs intersecting one another, pivotally connected to said positioning apparatus at the intersection of the legs, the first leg being pivotal about a first axis remote from the intersection, the second leg being pivotally connected to the cross member.

2. The lift chair of claim 1 wherein the control means are designed to be hand-held by the chair occupant.

3. The lift chair of claim 1 wherein the control means extend/retract function is actuated by a single rocker-type switch.

4. A lift chair comprising:

a. a base frame;

b. an extendable/retractable chair occupant positioning apparatus, attached to the base frame;

c. a reversible motor for extension and retraction of said chair occupant positioning apparatus relative to the base frame;

d. a control means connected to said motor for actuation of said chair occupant positioning apparatus;

e. a power supply connected to the control means for motor control;

f. a chair occupant carriage supported by the base frame, the carriage comprising at least seat and back portions;

g. heat radiating means on at least one carriage section;

h. a triangular bell crank having three pivotal connections, including a pivotal connection to said positioning apparatus.

5. The lift chair of claim 4 further comprising heat control means.

6. The lift chair of claim 4 further comprising a chair occupant leg horizontal support portion including heat radiating means controlled by a central means connected to the chair occupant positioning apparatus, extendable from a position beneath a lower-most chair occupant support member relative to the base, such that chair occupant leg support portion is variable in height relative to the floor.

7. A lift chair comprising:

a. a base frame;

b. an extendable/retractable chair occupant positioning apparatus, attached to the base frame;

c. a reversible motor for extension and retraction of said chair occupant positioning apparatus relative to the base frame;

e. a chair occupant carriage supported by the base, frame the carriage comprising at least seat and back portions;

f. therapeutic massage means on at least one carriage section;

g. a low voltage control means having switch means connected to said motor for actuation of said chair occupant positioning apparatus and having switch means connected to the massage means;

h. a power supply connected to the control means for motor control; and i. a triangular bell crank pivotally connected to said positioning apparatus and said seat.

8. The lift chair of claim 7 further comprising a leg supporting portion including therapeutic massage means controlled by the control means connected to the chair occupant positioning apparatus, extendable from a position beneath a lower-most chair occupant support member relative to the base, such that chair occupant leg support is variable in height relative to the floor.

9. The lift chair of claim 7 further comprising heat radiating means on at least one carriage section and a switch means on the control means connected to each controlling the heat radiating means.

10. The lift chair of claim 8 further including a massage and heat function actuator.

11. The lift chair of claim 10 wherein the massage function is performed by a plurality of vibrating modules and means on the control means for selecting specific modules for activation.

12. The lift chair of claim 10 wherein the control means are handheld and low voltage.

13. The lift chair of claim 10 wherein the control means is actuated by a single rocker-type switch in different settings to extend or retract the chair occupant position apparatus.

14. The lift chair of claim 10 wherein the massage function is performed by a plurality of sequentially operable vibrating modules and means on the control means for varying the sequences of operation of the vibrating modules.

15. The lift chair of claim 14 wherein the plurality of massage modules are sequentially activated for a period of time then deactivated, such that activation of one deactivates the remaining modules in sequence.

16. The lift chair of claim 1 further comprising a battery back-up means such that the extend/retract apparatus can be retracted in the event of a power failure.

17. The lift chair of claim 16 wherein the batteries are recharged by a charging circuit connected to the power supply.

18. A lift chair including:

a. an environmental control system having high current apparatus electrically isolated from a control path, comprising:

i. a support member;

ii. low voltage switching means attached to the support member; and iii. communication means for transmitting low voltage switching signals from the support member to said lift chair.

19. The lift chair of claim 18 wherein the support member is hand operated by the chair occupant.

20. The lift chair of claim 18 wherein the low voltage switching means controls a heat radiating device.

21. The lift chair of claim 18 wherein the low voltage switching means controls a therapeutic massage unit.

22. The lift chair of claim 18 comprising a lift chair motor having extension and retraction functions, wherein the low voltage switching means controls extend/retract functions of the lift chair motor.

23. A motor driven lift chair movable through a continuous range from a recline position at which a back portion of said chair is reclined relative to a seat portion thereof and a leg support portion extends from said seat portion for horizontally supporting lower extremities of a chair occupant through a position at which said back portion is upright relative to said seat portion and said leg support portion continues to be in said lower extremities horizontal support position and further through a position at which said leg support portion extends downwardly from said seat portion thereby to permit a chair occupant's lower extremities to extend towards the floor, to a position at which said leg support portion remains so-positioned and said back and seat portions remain at a constant angle therebetween and are lifted and pitched forward to assist an occupant in arising from said chair, comprising:

a. means for moving said seat, back and leg support portions responsively to said motor comprising:

i a base;

ii. an arm pivotally connected to said base for arcuate vertical movement with respect thereto;

iii. a frame side member connected to an end of said arm remote from said base, lifted by said arm upon arcuate motion of said arm relative to said base;

iv. a frame cross-member extending generally transversely respecting said chair, comprising:

(1) a central portion; and (2) a vertical portion extending generally downwardly from said central portion;

b. said frame cross-member being attached to said frame side member at a position vertically removed from said central portion.

24. A lift chair comprising:

a. a seat portion;

b. a back portion forming an angle with said seat;

c. a leg support portion;

d. a D.C. motor comprising:

i. a worm gear;

ii. a rack for providing longitudinal motion via a sleeved motor extension shaft;

iii. said worm gear being connected to a motor output shaft and said rack moving said motor extension shaft and sleeve upon rotation of said worm gear, one of said worm gear and rack being metal and a remainder being plastic;

iv. a tubular member extending from said motor, said tubular member having an exit end;

v. said sleeved motor extension shaft being telescopically movable in and out of said tubular member;

vi. a bushing at the exit end of said tubular member slidably receiving said sleeved motor extension shaft;

vii. said sleeved motor extension shaft being coated with a permanent solid lubricant to facilitate sliding motion as said sleeved motor extension shaft telescopes in and out of said tubular member upon rotation of said D.C. motor and extension/retraction of said rack in response thereto;

e. a support frame comprising:

i. longitudinally spaced transversely extending front and rear frame base rails;

ii. a pair of transversely spaced longitudinally extending side frame base rails, rigidly connected to said front and rear frame base rails remotely from ends of said front and rear frame base rails, said side frame base rails and said front and rear frame base rails being co-planar for supporting said lift chair on a floor;

iii. pairs of upstanding transversely spaced rear frame side plates fixedly connected to respective ones of said side frame base rails at positions of connection thereof with said rear frame base rail;

f. means for lifting said seat, back and leg support portions of said chair into position at which said seat and back portions are inclined forwardly to assist a chair occupant in arising therefrom, without changing the relative angle between said seat and back portions during lifting, comprising:

i. pairs of elevator arms vertically aligned with respective ones of said side frame base rails and pivotally mounted in and retained between respective rear frame side plates of said plate pairs for co-planar arcuate vertical movement with respect thereto;

ii. ends of said elevator arms remote from said rear frame side plates being pivotally mounted and retained between pairs of front frame side plates for rotation of said elevator arms about said positions of pivotal mounting in said rear frame side plates resulting in arcuate upward movement of said remote ends of said elevator arms and said front frame side plates having said ends sandwiched therebetween;

iii. a pair of elevator frame side members retained between respective front frame side plates of said pairs and extending generally longitudinally therefrom;

iv. a one piece tubular rectangular cross section front elevator frame cross-member attached to said front frame side plates, said front elevator frame cross-member extending generally transversely respecting said chair, comprising:

(1) a transverse central portion extending between said positions of attachment to said front frame side plates, (2) intermediate portions extending generally downwardly from transverse extremities of said central portion and being connected thereto via a gentle curvature; and (3) extremity portions extending outwardly in a gentle curvature in a transverse direction from lower portions of said intermediate extending portions;

v. a one piece tubular rectangular cross section rear elevating frame cross-member fixedly connected to said elevating frame side members proximate rear extremities of said elevating frame side members, said rear elevating frame cross-member, comprising:

(1) a transverse central portion;

(2) generally vertical intermediate portions extending downwardly from said central portion and connected thereto via a gentle curvature and (3) extremity portions extending transversely outwardly in a gentle curvature from respective lower vertical extremities of said intermediate portions, said rear elevating frame cross-member being connected to said elevating frame side members via complemental contact therewith along said vertical portions of said rear elevating frame cross-member below said curvature;

vi. a generally right triangular bell crank pivotally connected, at a vertex of said triangular bell crank adjoining the hypotenuse of said triangularly configured bell crank, to said front elevating frame cross-member proximate a midpoint of said transverse central portion thereof, said bell crank being pivotally connected to said motor extension shaft at a position remote from said motor and rotatable in response to extension of said motor extension shaft, said position of pivotal connection of said bell crank to said motor extension shaft being proximate to a vertex of said bell crank which is a right angle, said bell crank being rotatable about a transverse axis at said pivotal connection with said front elevating frame cross-member from a position contacting said front elevating frame cross-member to a position at which said bell crank has rotated away from and out of contact with said front elevating frame cross-member;

vii. a T-bracket pivotally connected to said bell crank at a vertex position of said triangular bell crank defining an extremity position at a second vertex adjoining the hypotenuse of said right angularly configured bell crank remote from said position of bell crank pivotal connection to said front elevating frame cross member, said T-bracket comprising:

(1) a leg support portion pivotally connected to said bell crank for pivotal motion respecting said bell crank about a transverse axis, (2) a transversely extending cross-member;

(3) a pair of longitudinal seat portion support linkage bars fixedly connected to said cross-member at respective transverse extremities thereof, said longitudinal seat support linkage bars being parallel one with another; and viii. a pair of chair seat portion support brackets pivotally connected to respective ones of said longitudinal seat portion support linkage bars at extremities thereof remote from connection with said cross-member of said T-bracket, said chair seat portion support brackets being fixedly secured via screw means to said seat portion of said lift chair;

g. advancement of said motor extension shaft with said bell crank contacting said front elevating frame cross member lifting said front elevating frame cross member and rotating said upper and lower elevator arms thereby lifting said chair elevating frame including said elevator frame side members and said rear elevator frame cross member to a level higher than said front elevator frame cross member thereby tilting said chair seat and back portions forwardly to assist an occupant in arising from said chair;

h. means for moving said leg support portion from a downwardly extending position to a horizontal support position prior to said back portion reclining and thereafter reclining said back portion while maintaining said leg support portion in the horizontal support position responsively to bell crank rotation in a range removed from said front elevating frame cross-member, comprising:

i. a first generally longitudinally extending bar;

ii. a second generally longitudinally extending bar pivotally connected to said first bar at a position more proximate a front end of said first bar then a rear end thereof;

iii. a third generally longitudinally extending bar fixedly connected to said seat portion of said chair;

iv. a fourth generally longitudinal bar pivotally connected to said first bar more proximate the rear end of said first bar than to the forward end of said first bar;

v. a fifth pivotally movable bar of generally triangular shape, said fifth pivotally movable bar pivotally connected to said third longitudinal bar proximate a forward end thereof, said connection being proximate one vertex of said triangularly shaped fifth pivotally movable bar, said fifth pivotally movable bar being pivotally connected to said fourth longitudinal bar proximate a forward end thereof at a second vertex of said triangularly shaped fifth pivotally movable bar;

vi. a sixth pivotally movable bar being pivotally connected to said third longitudinal bar proximate a rear end thereof and being pivotally movable respecting said third longitudinal bar and said seat portion, said sixth pivotally movable bar being pivotally connected to an end of said second pivotally movable bar remote from a point of connection with said first bar;

vii. said second bar and fourth bars being pivotally connected proximate their respective midpoints;

i. rotation of said bell crank away from said front elevator frame cross-member upon retraction of said motor shaft extension portion moving said seat portion slightly rearwardly unitarily with said chair seat support bracket thereby moving said third bar rearwardly and rotating said sixth bar and said fifth bar clockwise until sixth bar rotation is halted and lifts a rear end of said second bar causing said second bar to rotate about a point of pivotal connection with said first bar thereby causing the center portion of said second bar to lift a point of pivotal connection between the second bar and the sixth bar and raising a central portion of fourth bar due to a pivotal connection thereof with said second bar at a midpoint thereof;

i. a scissors linkage for moving said leg support portion of said chair from a vertical position to a leg horizontal support position, comprising:

(1) a first link pivotally connected to said third longitudinal bar proximate a forward end of said third bar;

(2) a second link pivotally connected to said fifth triangularly shaped pivotally movable bar at a third vertex thereof;

(3) an end of said first link remote from a point of pivotal connection with said third longitudinal bar being pivotally connected to said second link proximate the mid-point of said second link;

(4) a third link pivotally connected to said first link at a point of connection thereof with said second link;

(5) a fourth link pivotally connected to said second link at an extremity thereof remote from a point of connection of said second link with said fifth pivotally movable bar;

(6) a fifth link pivotally connected to said third link at extremity thereof remote from point of connection of said third link with said first link;

(7) said fourth link and said fifth link being pivotally connected proximate respective mid-points thereof;

(8) a sixth link pivotally connected to said fourth link at an extremity thereof remote from connection of said fourth link and said second link;

(9) extremities of said fifth link and said sixth link remote from said points of connection with said fourth link being pivotally connected to said leg support portion of said chair at separated pivotal connection points;

i. rearward movement of said third bar in response to rotation of said bell crank away from said front elevator frame cross-member resulting from retraction of said motor extension shaft rotating said fifth pivotally movable bar and causing convergence of points of pivotal connection of said first link with said third bar and said second link with said fifth bar thereby producing a scissors-type motion to extend said linkage and move said leg support portion from a vertical position to a leg horizontal support position.

25. A lift chair comprising:

a. a seat portion;

b. a reclinable back portion;

c. a leg support portion movable between a position extending downwardly from said seat portion and a position for horizontally supporting lower leg lower extremities of a chair occupant;

d. D.C. motor driven means for moving said leg support portion from said downwardly extending position to said horizontal support position prior to said back portion reclining, reclining said back portion while maintaining said leg support portion in the horizontal support position, and lifting said seat and back portions while maintaining a preselected angle therebetween into a position at which said seat and back portions pitch forwardly thereby facilitating a chair occupant in arising therefrom.

26. A lift chair comprising:

a. a seat portion;

b. a back portion;

c. a leg support portion;

d. a motor; and e. means connecting said motor to said seat, back and leg support portions, for moving said portions sequentially in response to said motor from a position of reclinement of said back portion with said leg support portion substantially horizontally supporting lower extremities of a chair occupant through a position at which said back portion is relatively upright to define a seated position at which said leg support portion remains in position to substantially horizontally support said chair occupant's lower extremities, through a further position at which said leg support portion extends downwardly from said seat portion so that said chair occupant's lower extremities may extend towards the floor to a yet further position at which said chair seat, back and leg support portions have been lifted and tilted forwardly to assist a chair occupant in arising therefrom.

27. A motor driven lift chair movable through a continuous range from a recline position at which a back portion of said chair is reclined relative to a seat portion thereof and a leg support portion extends from said seat portion for horizontally supporting lower extremities of a chair occupant through a position at which said back portion is upright relative to said seat portion and said leg support portion continues to be in said lower extremities horizontal support position and further through a position at which said leg support portion extends downwardly from said seat portion thereby to permit a chair occupant's lower extremeties to extend towards the floor, to a position at which said leg support portion remains so-positioned at said back and seat portions remain at a constant angle therebetween and are lifted and pitched forward to assist an occupant in arising from said chair, comprising:

a. a motor including an extendible shaft portion for extending or retracting according to direction of motor rotation;

b. a bell crank pivotally connected to said motor shaft for rotation responsively to extension/retraction of said motor shaft;

c. a base for supporting said chair;

d. said motor being pivotally connected to said base for arcuate motion of said motor upon extension/retraction of said motor shaft;

e. said bell crank being pivotally connected to a chair seat support member at a pivotal connection removed from said pivotal connection of said bell crank and said motor shaft;

f. said bell crank being further pivotally connected to a first bar of said four bar linkage;

g. said base defining a second bar of said four bar linkage;

h. third and fourth bars of said four bar linkage being elevator bars connecting said base with said first bar and raising said first bar relative to said base upon extension of said motor shaft rotating said bell crank into abutting disposition with said seat support member and thereafter causing said third and fourth elevator bars to elevate said first bar in response to continued extension of said motor shaft.

28. The motor driven lift chair of claim 27 wherein said axes of said pivotal connections are all parallel.

29. The motor driven lift chair of claim 27 wherein said axis of pivotal connection of said motor shaft and said bell crank is vertically above said axis of pivotal connection of said bell crank with said first bar when said bell crank initially contacts said first bar due to extension of said motor shaft.

30. The motor driven lift chair of claim 27 wherein said bell crank is triangular.

31. The motor driven lift chair of claim 27 wherein said triangular is three-four-five right triangle and said pivotal connection of said motor shaft and said bell crank is opposite the hypotenuse of said triangle.

32. The motor driven lift chair of claim 27 wherein said four side of said triangle connects said pivotal connection of said motor shaft and said bell crank with said point of pivotal connection between said bell crank and said first bar.

33. A lift chair comprising:

a. a base frame;

b. a seat vertically displaceable relative to the base frame;

c. a drive mechanism operable between retracted and extended positions wherein operation of the driving mechanism toward an extended position causes the seat to be displaced vertically upwardly;

d. an elongated cross member extending laterally beneath the seat, pivotally connected to the seat;

e. a crank arm having two transverse legs intersecting one another, pivotally connected to the drive mechanism at the intersection of the legs, one leg being pivotal about a first axis remote from the intersection, the second leg being pivotally connected to the cross member.

34. The lift chair of claim 33 comprising a stop limiting forward rotation of the crank arm when the drive mechanism is operated toward an extended position.

35. The lift chair of claim 33 comprising a connecting link pivotally connected to the second leg of the crank arm and rigidly connected to the cross member.

36. The lift chair of claim 33 wherein the crank arm is a triangularly shaped bell crank.

37. The lift chair of claim 33 wherein the two legs of the crank arm are rigidly connected.

38. The lift chair of claim 33 comprising a motor operable to drive the driving mechanism between retracted and extended positions.

39. The lift chair of claim 33 wherein the drive mechanism comprises a variable length telescoping extension rod.

40. A lift chair comprising:

a. a base frame;

b. a seat vertically displacable relative to the base frame;

c. a drive mechanism operable between extended, intermediate, and retracted positions;

d. a foot rest adjacent a forward end of the seat;

e. a triangular crank arm pivotable about a pivot axis and pivotally connected to an extension rod remote from the pivot axis, the pivot axis being generally fixed when the drive mechanism is operated between the intermediate and the retracted positions, and the pivot axis being vertically displacable when the drive mechanism is operated from the intermediate position to the extended position;

f. an extension linkage connected to the foot rest and the crank arm such that operating the drive mechanism from the intermediate to the retracted position operates to extend the foot rest away from the seat.

41. The lift chair of claim 40 comprising a cross member extending laterally beneath the seat, pivotally connected to the crank arm and the seat.

42. The lift chair of claim 41 comprising a connecting link pivotally connected to the crank arm remote from the pivot axis and rigidly connected to the cross member.

43. The lift chair of claim 40 comprising a motor operable to drive the drive mechanism between the extended, intermediate, and retracted positions.

44. The lift chair of claim 40 wherein the drive mechanism comprises a variable length telescoping extension rod.

45. A lift chair comprising:

a. a base frames;

b. a seat vertically displacable relative to the base frame;

c. a telescoping drive mechanism operable between extended and retracted positions;

d. a seat back transverse the seat, operable between an upright position and a reclined position;

e. a foot rest adjacent a forward end of the seat;

f. a foot rest linkage connecting the drive mechanism and the seat such that operation of the drive mechanism from an extended position to an intermediate retracted position extends the foot rest to an extended position away from the seat, while the seat back is maintained in the upright position;

g. a seat back linkage connecting the drive mechanism and the seat back such that operation of the drive mechanism from the intermediate retracted position to a further retracted position pivots the seat back from the upright position to the reclined position, while the foot rest is maintained in the extended position.

46. The lift chair of claim 45 comprising a triangular crank arm pivotally connected to the drive mechanism.

47. The lift chair of claim 46 comprising an elongated cross member extending laterally beneath the seat, pivotally connected to the seat and the crank arm.

48. The lift chair of claim 47 comprising a connecting link pivotally connected to the crank arm remote from the drive mechanism and rigidly connected to the cross member.

49. The lift chair of claim 45 comprising a motor operable to drive the drive mechanism between the extended and retracted positions.

50. A lift chair comprising:

a. a base frame;

b. a seat vertically displaceable relative to the base frame;

c. a telescoping drive mechanism connected to said seat and said frame and being operable between extended and retracted positions corresponding to movement of said seat relative to said frame;

d. a seat back transverse to the seat, operable between an upright position and a reclined position;

e. a foot rest adjacent a forward end of the seat;

f. a foot rest linkage connecting the foot rest to the drive mechanism such that operation of the drive mechanism from an extended position to an intermediate retracted position translates the seat linearly relative to the base frame and extends the foot rest away from the seat;

g. a seat back linkage connecting the seat back to the drive mechanism such that operation of the drive mechanism from the intermediate retracted position to the retracted position pivots the seat, seat back and foot rest about a pivot axis.

51. The lift chair of claim 50 wherein the seat is not displaced vertically upwardly when the drive mechanism is operated from the extended position to the intermediate retracted position.

52. The lift chair of claim 50 comprising a triangular crank arm pivotally connected to the drive mechanism.

53. The lift chair of claim 52 comprising an elongated cross member extending laterally beneath the seat, pivotally connected to the seat and the crank arm.

54. The lift chair of claim 53 comprising a connecting link pivotally connected to the crank arm remote from the drive mechanism and rigidly connected to the cross member.

55. The lift chair of claim 50 comprising a motor operable to drive the drive mechanism between the extended and retracted positions.

56. A lift chair comprising:

a. a base frame b. a seat vertically displaceable relative to the base;

c. a telescoping drive mechanism operable between extended and retracted positions;

d. a seat back transverse the seat operable between an upright position and a reclined position;

e. a foot rest adjacent the forward end of the seat;

f. means for sequentially extending the foot rest away from the seat and then pivoting the seat back from the upright position to a reclined position.

57. The lift chair of claim 56 comprising a triangular crank arm pivotally connected to the drive mechanism.

58. The lift chair of claim 56 comprising an elongated cross member extending laterally beneath the seat, pivotally connected to the seat and the crank arm.

59. The lift chair of claim 58 comprising a connecting link pivotally connected to the crank arm remote from the drive mechanism and rigidly connected to the cross member.

60. The lift chair of claim 56 comprising a motor operable to drive the drive mechanism between the extended and retracted positions.

61. A lift chair comprising:

a. a base frame;

b. a seat vertically displacable relative to the base frame;

c. a telescoping drive mechanism operable between extended and retracted positions;

d. a seat back transverse the seat operable between an upright position and a reclined position;

e. a foot rest adjacent a forward end of the seat;

f. means for translating the seat linearly relative to the base frame; and g. means for pivoting the seat, seat back and foot rest about a pivot axis.

62. The lift chair of claim 61 wherein the means for translating does not vertically displace the seat when the drive mechanism is operated from the extended position to an intermediate retracted position.

63. The lift chair of claim 61 comprising a triangular crank arm pivotally connected to the drive mechanism.

64. The lift chair of claim 61 comprising of an elongated cross member extending laterally beneath the seat, pivotally connected to the seat and the crank arm.

65. The lift chair of claim 64 comprising a connecting link pivotally connected to the crank arm remote from the drive mechanism and rigidly connected to the cross-member.

66. The lift chair of claim 61 comprising a motor operable to drive the drive mechanism between the extended and retracted positions.

* * * * *